US008169166B2

(12) United States Patent
Alimov et al.

(10) Patent No.: US 8,169,166 B2
(45) Date of Patent: May 1, 2012

(54) LOW-INJECTION ENERGY CONTINOUS LINEAR ELECTRON ACCELERATOR

(75) Inventors: Andrei Sergeevich Alimov, Moscow (RU); Boris Sarkisovich Ishkhanov, Moscow (RU); Nikolai Ivanovich Pakhomov, Moscow (RU); Viktor Petrovich Sakharov, Moscovskaya obl. (RU); Vasily Ivanovich Shvedunov, Moscow (RU)

(73) Assignees: Obschestvo S Ogranichennoi Otvetstvennostyu 'Nauka I Tekhnologii, Moscow (RU); Federalnoe Gosudarstvennoe Uchrezhdenie 'Federalnoe Agentstvo Po Pravovoi Zaschite Resultatov Intellektualnoi Deyatelnosti Voennogo, Spetsialnogo I Dvoinogo Naznachenia' Pri Ministertve Yustitsii Rossiyskoy Federatsii, Moscow (RU); Nauchno-Issledovatelski Institut Yadernoi Fiziki Imeni D.V. Skobeltsina Moskovskogo Gosudarstvennogo Universiteta Imeni M.V. Lomonosova, Moscow (RU)

( * ) Notice: Subject to any disclaimer, the term of this patent is extended or adjusted under 35 U.S.C. 154(b) by 304 days.

(21) Appl. No.: 12/451,433

(22) PCT Filed: Dec. 12, 2005

(86) PCT No.: PCT/RU2005/000636

§ 371 (c)(1),
(2), (4) Date: Jul. 16, 2010

(87) PCT Pub. No.: WO2007/069931

PCT Pub. Date: Jun. 21, 2007

(65) Prior Publication Data

US 2010/0289436 A1 Nov. 18, 2010

(51) Int. Cl.
*H05H 9/04* (2006.01)
*H05H 7/00* (2006.01)

(52) U.S. Cl. ..... 315/505; 315/501

(58) Field of Classification Search ..... 315/500, 315/501, 502, 503, 504, 505, 506, 507
See application file for complete search history.

(56) References Cited

U.S. PATENT DOCUMENTS 6,376,990 B1 * 4/2002 Allen et al. ..... 315/5.41
6,407,505 B1 * 6/2002 Bertsche ..... 315/5.41
6,465,957 B1 * 10/2002 Whitham et al. ..... 315/5.41

* cited by examiner

*Primary Examiner* — Douglas W Owens
*Assistant Examiner* — Minh D A
(74) *Attorney, Agent, or Firm* — James Creighton Wray

(57) ABSTRACT

This invention relates to continuous standing-wave linear electron accelerator (9) comprising a low-energy electron source (10), for example, within a range of 10-20 keV, an accelerating structure (1 or 1') for accelerating low initial energy electrons to required values; at least, one high-frequency power supply (11) for the said accelerating structure (1 or 1'); a power supply (13) for said electron source (10) and high-frequency power supply (11); a receiving antenna (14), which is arranged in accelerating unit of accelerating structure (1 or 1') and is used for emitting of high-frequency signal for controlling the amplitude and phase of accelerating field. Low-energy electron beam is directed to the first unit of accelerating structure (1 or 1') contained successively accelerating units (2, 3, 4*i*). The first of them is embodied in the form of a bunch resonator (2), the second unit is embodied in the form of a buster resonator (3), and successive units (4*i*) are used for increasing the electron energy. Also the following is proposed: selection of geometrical parameters of accelerating units, the versions of their arrangement in the said accelerating structure and the use of power supply modes by different high-frequency power sources such as magnetrons, externally excitable klystrons or klystrons operating in a self-oscillating mode with accelerating structure in a feedback circuit.

24 Claims, 8 Drawing Sheets

LOW-INJECTION ENERGY CONTINOUS LINEAR ELECTRON ACCELERATOR

This application claims the benefit of PCT/RU2005/000636 filed Dec. 12, 2005, which is hereby incorporated by reference in its entirety.

FIELD OF INVENTION

This invention relates to the area of physics, in particular, to process of low-injection energy electrons acceleration in continuous linear accelerator, i.e. to accelerating structures of linear accelerator with standing wave.

PRIOR ART

High-voltage electron beams are widely used not only for scientific and applied researches, but also for solution of environmental tasks, as well as in industry for development of new material-processing technologies for acquisition of new properties or disposal of hazardous wastes from different producing operations. Development of new technologies requires the increase of electron beam permeability, i.e., electron energy increase, as well as increase of average bunch power.

Until recently, direct accelerators based on high-voltage transformer or cascade generators in the area of energies up to 5 MeV and more compact pulse linear accelerators having significantly lower bunch power in the area of energies up to 10 MeV were the basic sources of electrons with high bunch power.

Use of direct electron accelerators in most technological processes is complicated due to big dimensions of accelerators requiring specially equipped premises and limiting the formation of local radiation shielding, as well as due to necessity of using expensive insulation gas under high pressure to reduce probability of high-voltage breakdown.

From the other hand, in the area of energies up to 5 MeV bunch power of pulse linear accelerators is several times lesser than bunch power of direct linear accelerators.

Accordingly, its is essential to develop continuous linear accelerators, in particular, those with standing wave, combining compactness and high average bunch power at the absence of voltages (both high-frequent and constant) increasing several tens of kilovolts.

However, when realizing the concept of continuous linear accelerator, some specific problems arise due to low, approx. 1 MeV/m, rate of energy increase limited by permissible level of thermal loads of accelerating structure and acceleration efficiency requirements. In particular, the following problems arise.

1. Specialists know that in the range of wavelengths 10-12 cm, the increase of electron energy in continuous linear accelerator after transmission through one accelerating structure is 30-60 keV, whereupon electron velocity is close to light velocity only after transmission of 10 structures and above.

That's why, in order to provide electron synchronization with accelerating field of accelerating structures' length, where electrons velocity slightly differs from light velocity (electrons energy is higher than rest energy equal to 0.511 MeV), they should be selected according to definite rules considering the increase of particles' velocity.

2. Specialists know that in accelerating structures with standing wave, used for electrons acceleration, the length of accelerating structure can not be less than quarter of accelerating field length.

Therefore, the length of injected particles, $v_0$, should be close to half of light velocity c, i.e. relative velocity $\beta_0=v_0/c\geqq 0.4\div 0.5$, which corresponds to high injection energy exceeding 70-80 keV.

3. Specialists know that in order to increase high ratio of particles capture in linear accelerator, the particles should be previously grouped.

To provide effective grouping, definite ratio should be maintained between energy modulation amplitude in bunch resonator and the length of drift segment, at which particles are grouped into bunches; the higher is particles energy, the greater should be absolute energy modulation value or the length of drift segment.

In order to prevent de-grouping in the course of acceleration, the energy modulation amplitude should be significantly lower than particles energy increase per structure. Generally, modulation amplitude for continuous accelerator doesn't exceed 5 keV. That's why, 0.5-1 m long drift segment between bunch resonator and accelerating structure is needed at high injection energy, which significantly increases accelerator's dimensions.

4. Specialists in the area of particles acceleration know that due to high level of high-frequency losses per structure length of accelerating structure, exceeding 15-20 kW/m, significant heating of accelerating structure elements occurs in continuous linear accelerator, as well as temperature gradients and, as a consequence, deformations and resonance frequency offsets of accelerating structures and connection cells arise, leading to the change of resonance frequencies of accelerating structure and the occurrence of stop band in its disperse characteristics. Even if accelerating structure elements are intensively cooled, resonance frequency offset of accelerating structure, when feeding-in high-frequency power, may exceed the line width at half-height. This circumstance embarrasses the feeding-in procedure of high-frequency power, in particular, in multi-sectional accelerator at operation of klystrons with external driving generator providing their excitation. Complicated system of control and resonance frequencies stabilization of individual sections is needed for functioning of such accelerator.

It is also known that, if exterior bunch resonator is absent, parameters of linear accelerator with standing wave, such as injection energy, portion of injected bunch current caught into acceleration mode, power of bunch current losses at the walls of accelerating structure and on cathode of electron gun, dimensions, bunch divergence and output energy distribution are specified by characteristics of starting part of an accelerator providing formation of electron beams from continuous non-relativistic bunch of electron gun and their focusing and acceleration up to relativistic energy.

Different accelerating structures for linear accelerators are known.

Continuous linear accelerator with low velocity of injected particles (U.S. Pat. No. 5,744,919, A) is known. It contains, at least:

- source of charged particles providing the stream of charged particles with velocities lower than minimal velocity of injected particles necessary for effective acceleration in high-frequency linear accelerator without drift tubes;
- first linear accelerator with one or more resonators, each with drift tube within, adopted for acquisition of charged particles from the source and for particles acceleration from initial velocity, which they have, when entering the resonator, up to minimal velocity needed for effective acceleration in linear accelerator without drift tubes;

second linear accelerator with one or more resonators, not having drift tubes, adopted for particles acquisition from the first linear accelerator and for acceleration thereof up to relativistic velocity;

microwave energy source connected to first and second linear accelerators, so that it excites $TM_{010}$ oscillation within;

connecting structure linking the said microwave energy in the first accelerator and the second accelerator, so that they provide phase shift, at which charged particles going from the mentioned first accelerator enter in the first resonator of the said second accelerator in the time, when electric field of mentioned $TM_{010}$ oscillation in the first resonator of second accelerator is oriented so that it accelerates the mentioned particles.

The task specified for this linear accelerator envisages the capture of electrons with low initial velocity into acceleration mode at $\beta_0 \geqq 0.1 \div 0.2$, in continuous linear accelerator.

However, firstly, it is known that affixtures of drift tubes installed in accelerating resonators lead to significant reduction of their soundness, which increases microwave power losses and structure heating.

Secondly, affixtures presence leads to asymmetry occurrence in electromagnetic field distribution against the axis of an accelerator, which adversely impacts onto lateral movement of flow-energy bunch.

Thirdly, the analogue has no elements, which could provide particles grouping. These disadvantages increase current losses in transit channels, thereby limiting the achievable bunch power and increasing the radiation background of accelerator and reducing the accelerator's effectiveness.

There is known the method of electrons acceleration with high injection energy and continuous linear electron accelerator with standing wave (A. S. Alimov, K. A. Gudkov, D. I. Yermakov, PTE No. 5, 1994, pgs 7-22), containing the electron source fed from high-voltage power supply, and accelerating structure and connecting structure in between, where electron beam is grouped by external resonator fed from microwave power source using regulatory carrier link; thereupon, grouped electron beam is focused by lens and accelerated in accelerating structures, and its length is growing in proportion to an increase of accelerated particle velocity.

Meantime, supply voltage is fed from high-voltage rectifier to electron source and microwave power source.

However, in order to get powerful electron beam at rectifier's output at high, between 80-100 keV, injection energy, the power of injected bunch should be 5-10 kW, from which, at least, the half is lost in transit channel of accelerator, thereby limiting the achievable bunch power and increasing the radiation background of accelerator and reducing the accelerator's effectiveness.

Meantime, separate powerful high-voltage rectifier is needed for electron gun supply. Besides this, the presence of standalone bunch resonator significantly increases the accelerator's dimensions and complicates high-voltage supply system.

DISCLOSURE OF INVENTION

This invention is targeted to create compact linear accelerator providing acceleration of electrons with low initial energy, in particular, those with initial relative velocity $\beta_0 \approx 0.2$, with possibility of its modification, depending on required output parameters of electron beam.

When creating this invention, the task was set to develop compact linear accelerators for low-energy electrons acceleration up to required values by capture factor increasing without external resonator, by consistent electrons grouping directly in accelerating structure under the impact of high-frequency electromagnetic field of required intensity, based on initial electrons velocity and optimal relationship of grouping modes and electrons accelerations. Besides this, there was set a task of high-frequency feed optimization for acceleration structure in multi-sectional and single-sectional versions of accelerator.

The set task was solved by development of acceleration method of low-injection energy electrons in continuous linear accelerator with standing wave, including:

low-energy electron source;

accelerating structure for electrons with low initial energy;

high-frequency power supply providing power for the said accelerating structure;

power source supplying the said electron source and the said high-frequency power supply;

And, in the meantime, the said accelerating structure includes successive accelerating structures adopted for formation of electromagnetic field under the source of high-frequency power, where each previous accelerating structure is connected to the following one by coupling slots through connection structure. In the said accelerating structure:

first accelerating structure is implemented in the form of bunch resonator adopted for direct communication with low-energy electrons source, second accelerating structure is implemented in the form of booster resonator, adopted for energy increase of incoming electrons up to the values providing their acceleration in the following part of accelerating structure, structures following after the second accelerating structure are adopted to increase the energy of entering electrons up to required value and, at least, for accelerating structures, to which non-relativistic electrons enter with kinetic energy less than rest energy, the length of each following segment of accelerating structure located between the centers of adjacent connection cells and comprising the said accelerating structure, relates to that in the previous segment, as the average electron velocity in the previous segment relates to that in the following segment;

the distance $L_g$ between the gap centers of bunch resonator and booster resonator is selected according to velocity $v_0$ of electron stream at the input into bunch resonator and microwave field wavelength $\lambda$ of high-frequency power supply in free space, based on the following relation:

$$\frac{L_g}{\beta_0} = \frac{4n-1}{4}\lambda,$$

where $\beta_0 = v_0/c$, c is light velocity and n=1, 2, 3 . . . , and voltage $U_g$ at the gap of bunch resonator is selected from relation $$\frac{U_g}{U_0} \approx \frac{7.36}{\pi(4n-1)},$$

where $U_0$ is electron source voltage, n=1, 2, 3 . . . .

Besides this, according to this invention, it is reasonable that accelerating structures adopted for accelerating electrons with kinetic energy above rest energy, are adopted for further energy increase; meantime, the said segments of accelerating structure have equal lengths, and the length of individual segment in group and quantity of such segments were selected based on the condition that phase shift of accelerated particle with respect to accelerating field after its passage in a group of segments, doesn't exceed $10^0$.

Meanwhile, according to this invention, it is reasonable that accelerating structures are connected to each other through internal or side connection units.

Meanwhile, according to this invention, it is reasonable that the said accelerator uses the source of electrons providing electron stream with injection energy of 10-20 keV.

Meanwhile, according to this invention, it is reasonable that the said accelerator includes electron gun with thermal cathode and one or more electrodes to be used as electron source.

Meanwhile, according to this invention, it is reasonable that the said accelerator has the receiving antenna arranged in accelerating unit of the said accelerating structure and is used for producing of high-frequency signal for controlling the amplitude and phase of accelerating field.

Besides this, according to this invention, it is reasonable that the said accelerator contains magnetron as high-frequency power supply In addition, it includes:

- device providing mechanical control of magnetron operating frequency;
- decoupler providing magnetron protection from high-frequency signal reflected from the accelerating structure;
- directional coupler providing the acquisition of high-frequency signal for amplitude and phase control of magnetron output;
- mechanical control of magnetron operating frequency.

Besides this, according to this invention, it is reasonable that the said accelerator contains klystron, externally excited by driving generator with configurable frequency, operated as the source of high-frequency power and included the following:

- device for controlling of the said generator and amplitude monitoring of high-frequency signal at klystron input;
- decoupler providing klystron protection from high-frequency signal reflected from the accelerating structure;
- directional coupler providing the acquisition of high-frequency signal for amplitude and phase control of klystron output;
- amplitude monitor of high-frequency signal at klystron input.

Besides this, according to this invention, it is reasonable that the said accelerator contains klystron, excited by self-oscillator with accelerating structure in a feedback circuit, including the following:

- device for amplitude and phase monitoring of high-frequency signal at klystron input;
- amplitude monitor of high-frequency signal at klystron input.

The set task was also solved by creation of continuous linear electron accelerator with standing wave and low-injection energy, including:

- low-energy electron source;
- accelerating structure for electrons with low initial energy;
- several high-frequency power sources feeding the said accelerating structure, each of them connected with accelerating structure via decoupler and directional coupler;
- power source feeding the said electron source and the said high-frequency power supply;
- receiving antenna arranged in accelerating unit of the said accelerating structure and used for producing of high-frequency signal for controlling the amplitude and phase of accelerating field;

And, in the meantime, the said accelerating structure includes successive accelerating structures adopted for formation of electromagnetic field under the source of high-frequency power, where each previous accelerating structure is connected to the following one by coupling slots through connection structure. In the said accelerating structure:

- first accelerating structure is implemented in the form of bunch resonator adopted for direct communication with low-energy electrons source,
- second accelerating structure is implemented in the form of booster resonator, adopted for energy increase of incoming electrons up to the values providing their acceleration in the following part of accelerating structure,
- structures following after the second accelerating structure are adopted to increase the energy of entering electrons up to required value and, at least, for accelerating structures, to which non-relativistic electrons enter with kinetic energy less than rest energy, the length of each following segment of accelerating structure located between the centers of adjacent connection cells and comprising the said accelerating structure, relates to that in the previous segment, as the average electron velocity in the previous segment relates to that in the following segment;
- the distance $L_g$ between the gap centers of bunch resonator and booster resonator is selected according to velocity $v_0$ of electron stream at the input to bunch resonator and microwave field wavelength $\lambda$ of high-frequency power supply in free space based on the following relation:

$$\frac{L_g}{\beta_0} = \frac{4n-1}{4}\lambda,$$

where $\beta_0 = v_0/c$, c is light velocity and n=1, 2, 3 . . . , and voltage $U_g$ at the gap of bunch resonator is selected from relation $$\frac{U_g}{U_0} \approx \frac{7.36}{\pi(4n-1)},$$

where $U_0$ is electron source voltage, n=1, 2, 3 . . . .

Meantime, according to this invention, it is reasonable that accelerating structures for accelerating electrons with kinetic energy above rest energy, are adopted for further energy increase; meantime, the said segments of accelerating structure have equal lengths, and the length of individual segment in group and quantity of such segments are such that phase shift of accelerated particle with respect to accelerating field after its passage in a group of segments, doesn't exceed $10^0$.

Meanwhile, according to this invention, it is reasonable that accelerating structures are connected to each other through internal or side connection units.

Meanwhile, according to this invention, it is reasonable that the said accelerator uses the source of electrons providing electron stream with injection energy of 10-20 keV.

Meanwhile, according to this invention, it is reasonable that the said accelerator includes electron gun with thermal cathode and one or more electrodes to be used as electron source.

Meanwhile, according to this invention, it is reasonable that the said accelerator has the receiving antenna arranged in accelerating unit of the said accelerating structure and used for producing of high-frequency signal for controlling the amplitude and phase of accelerating field.

Besides this, according to this invention, it is reasonable that the said accelerator contains magnetron as high-frequency power supply. In addition, it includes:

- device providing mechanical control of magnetron operating frequency;
- mechanical controls of operating frequency for each of the said magnetrons.

Meantime, according to this invention, the accelerator can contain externally excited klystrons operated as a source of high-frequency power and adopted for synchronization with general high-frequency signal from driving generator with configurable frequency, and whereat it contains:

- power splitter for the said driving generator;
- device for controlling the said driving generator and amplitude and phase monitoring of high-frequency signal at inputs of the said klystrons;
- amplitude and phase monitor of high-frequency signal, located after the said power splitter, before the input of each of the said klystrons.

Besides this, according to this invention, the accelerator can contain klystrons, each of them operated in self-oscillating mode with accelerating structure in a feedback circuit, whereat containing:

- power splitter for high-frequency signal of the said antenna;
- device for amplitude and phase monitoring of high-frequency signal;
- amplitude and phase monitor of high-frequency signal, located after the said power splitter, before the input of each of the said klystrons.

The set task was solved by development of continuous linear accelerator with standing wave with low injection energy, including:

- low-energy electron source;
- accelerating structure for electrons with low initial energy, implemented in the form of several successively located sections not interconnected by electromagnetic field;
- several high-frequency power sources, each of them feeds one of the sections of the accelerating structure;
- power supply feeding the said electron source and the said high-frequency power sources;
- receiving antennas arranged in accelerating structure of each of the said accelerating structure and used for producing of high-frequency signal for controlling the amplitude and phase of accelerating field;

In the meantime, each section of the said accelerating structure includes successive accelerating structures adopted for formation of electromagnetic field under the source of high-frequency power, where each previous accelerating structure is connected to the following accelerating structure by coupling slots through connection structure. In the first section of the said accelerating structure:

- first accelerating structure is implemented in the form of bunch resonator adopted for direct communication with low-energy electrons source,
- second accelerating structure is implemented in the form of booster resonator, adopted for energy increase of incoming electrons up to the values providing their acceleration in the following part of accelerating structure,
- The distance $L_g$ between the gap centers of bunch resonator and booster resonator is selected according to velocity $v_0$ of electron stream at the input to bunch resonator and microwave field wavelength $\lambda$ of high-frequency power supply in free space based on the following relation:

$$\frac{L_g}{\beta_0} = \frac{4n-1}{4}\lambda,$$

where $\beta_0 = v_0/c$, c is light velocity and n=1, 2, 3 . . . , and voltage $U_g$ at the gap of bunch resonator is selected from relation $$\frac{U_g}{U_0} \approx \frac{7.36}{\pi(4n-1)},$$

where $U_0$ is electron source voltage, n=1, 2, 3 . . . .

and structures following after the second accelerating structure and accelerating structures of the following sections are adopted to increase the energy of entering electrons up to required value and, at least, for accelerating structures, to which non-relativistic electrons enter with kinetic energy less than rest energy, the lengths of adjacent connection cells located between the centers of accelerating structure are selected, so that the length of each following segment of accelerating structure relates to that of the previous segment, as the average electron velocity in the previous segment relates to that in the following segment;

And in the meantime, according to this invention, starting from the second section, it is reasonable that the segments of accelerating structure located between the centers of adjacent structure and included the accelerating structure, have equal lengths, and the length of individual segment in group and number of such segments are such that phase shift of accelerated particle with respect to accelerating field after its passage in a group of segments, doesn't exceed $10^0$.

Meanwhile, according to this invention, it is reasonable that accelerating structures are connected to each other through internal or side connection units.

Meanwhile, according to this invention, it is reasonable that the said accelerator uses the source of electrons providing electron stream with injection energy of 10-20 keV.

Meanwhile, according to this invention, it is reasonable that the said accelerator includes electron gun with thermal cathode and one or more electrodes to be used as electron source.

Besides this, according to this invention, it is reasonable that the said accelerator contains magnetrons as high-frequency power sources adopted to be synchronized with electromagnetic field signal generated by accelerated beam in the said accelerating section and entering to magnetron outputs via wave-guide duct and decoupler and superimposed by the signal of high-frequency field excited by magnetron in relevant accelerating section. Meantime, the said accelerator should include the following in each of the said sections:

- device providing mechanical control of magnetron operating frequency;
- decoupler providing magnetron protection from high-frequency signal reflected from the accelerating structure;
- directional coupler providing the acquisition of high-frequency signal for amplitude and phase control of magnetron output;
- mechanical control of magnetron operating frequency.

Besides this, according to this invention, it is reasonable that the said accelerator contains klystron, externally excited and synchronized with general high-frequency signal issued from driving generator via power splitter and operated as the source of high-frequency power, whereat containing:

device providing control of resonance frequency of the said accelerating section, as well as amplitude and phase monitoring of high-frequency signal;

decoupler providing klystron protection from high-frequency signal reflected from the accelerating structure;

directional coupler installed at the output of the said klystron and providing the acquisition of high-frequency signal for amplitude and phase control;

amplitude and phase monitors of high-frequency signals, located after the said power splitters before the inputs of the said klystrons;

resonance frequency controls for the said accelerating sections.

Besides this, according to this invention, the accelerator can contain klystrons, each of them operated in self-oscillating mode with accelerating structure in a feedback circuit and adopted for synchronization with high-frequency signal of the first accelerating section, whereat containing:

device for amplitude and phase monitoring of high-frequency signal at the input of the said klystron;

amplitude and phase monitor of high-frequency signal located before the input of klystron.

and thereat, it should contain device for offsetting of some part of high-frequency signal for the said antenna of the section;

as well as include the device for power splitting of the said offset signal for parts in such a quantity that is by one lesser that the quantity of accelerating structures in accelerating structure;

and contain for each of accelerating section, starting from the second:

device for amplitude and phase monitoring of high-frequency signal at the input of the said klystron;

device for dithering of the said part of this high-frequency signal into feedback circuit of the said klystron.

Meantime, according to this invention, the said accelerator can contain klystrons at high-frequency power sources of some accelerating sections. Each of them operates in self-oscillating mode with the said accelerating section in a feedback circuit and is adopted to be synchronized with electromagnetic field signal generated by accelerated beam in the said accelerating section and entering to klystron inputs from the said antenna. Than this signal is superimposed by the signal of high-frequency field excited by klystron in relevant accelerating section. Meantime, the said accelerator should include in each of the said sections:

device for amplitude and phase monitoring of high-frequency signal at the input of the said klystron;

amplitude and phase monitor of high-frequency signal located before the input of klystron.

Implementation of continuous linear accelerator according to this invention enables to create compact continuous linear accelerators with local radiation protection for the energy of 0.5-10 MeV with average beam power from some tens to some hundreds kW and full efficiency above 30%.

BRIEF DESCRIPTION OF DRAWINGS

The implementation of this invention is further clarified by description of examples and attached drawings, containing the following:

FIG. 4*a*; incorporating magnetron, 4*b*: incorporating externally excited klystrons, and FIG. 4*c*: incorporating self-oscillated klystrons.

FIG. 5*a*: incorporating magnetron, 5*b*: incorporating externally excited klystrons, and FIG. 5*c*: incorporating self-oscillated klystrons.

FIG. 6*a*: incorporating magnetron, 6*b*: incorporating externally excited klystrons, FIG. 6*c*: incorporating self-oscillated klystrons synchronized with feedback circuit signal of the first section, and FIG. 6*d*: incorporating self-oscillated klystrons synchronized with the signal guided by beam in accelerating structure.

Meantime, represented examples of implementation of linear accelerator for low-injection electrons don't go beyond this invention and don't limit the possibility of invention implementation.

BEST VERSION OF INVENTION IMPLEMENTATION

According to this invention, low-energy continuous linear electron accelerator can be implemented in different versions, e.g., as per the diagrams represented on FIGS. 4*a*, 4*b*, 4*c*, 5*a*, 5*b*, 5*c*, 6*a*, 6*b*, 6*c* and 6*d*.

Meantime, linear accelerator (FIGS. 4*a*, 4*b*, 4*c*, 5*a*, 5*b*, 5*c*, 6*a*, 6*b*, 6*c* and 6*d*) can contain accelerating structure implemented in the form of one-sectional accelerating structure 1 (FIG. 4*a*, 4*b*, 4*c*, and FIG. 5*a*, 5*b*, 5*c*) or multi-sectional accelerating structure 1' (FIGS. 6*a*, 6*b*, 6*c* and 6*d*) with allocated sections $\mathbf{1}_j$ at j=1, 2, . . . , including the accelerating structures.

Figure 1:
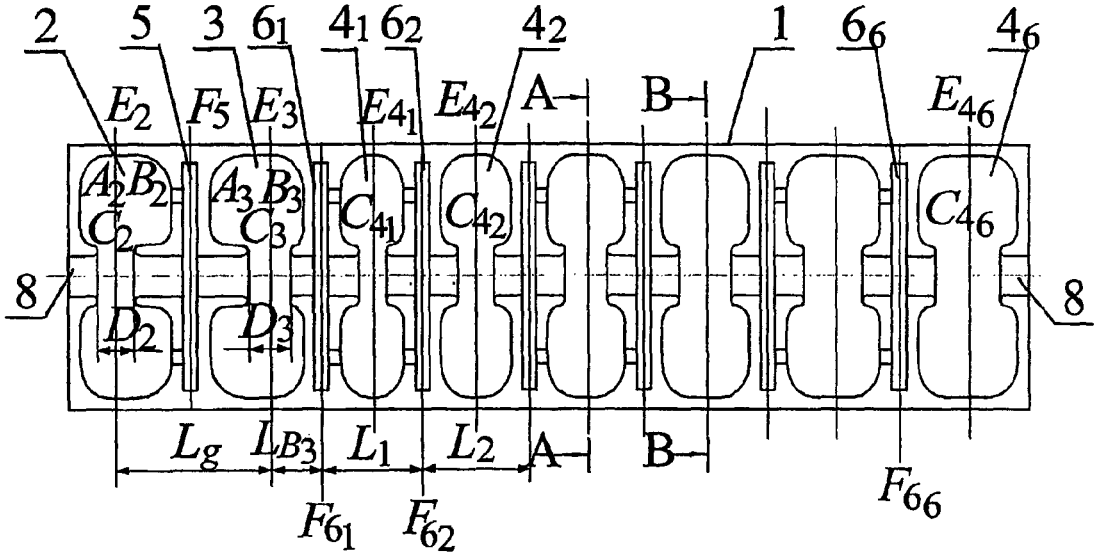
FIG. 1: diagram of accelerating structure with internal connection cells as per the invention.

Meantime, accelerating structures 1 and first section of multi-sectional structure 1' contain successively arranged structures, with first accelerating structure representing the bunch resonator 2, and second accelerating structure representing the booster resonator 3, as well as K successive accelerating units $\mathbf{4}_i$, i=1, . . . , K—e.g. as shown on the FIG. 1 at K=6.

Accelerating structures 2 and 3 are interconnected via connection cell 5, and accelerating units $\mathbf{4}_i$ and $\mathbf{4}_{i+1}$ are interconnected by connection cells $\mathbf{6}_{i+1}$ via coupling slots 7; meantime, accelerating units 3 and $\mathbf{4}_1$ are interconnected via connection cell $\mathbf{6}_1$ using the coupling slots 7.

Figure 2:
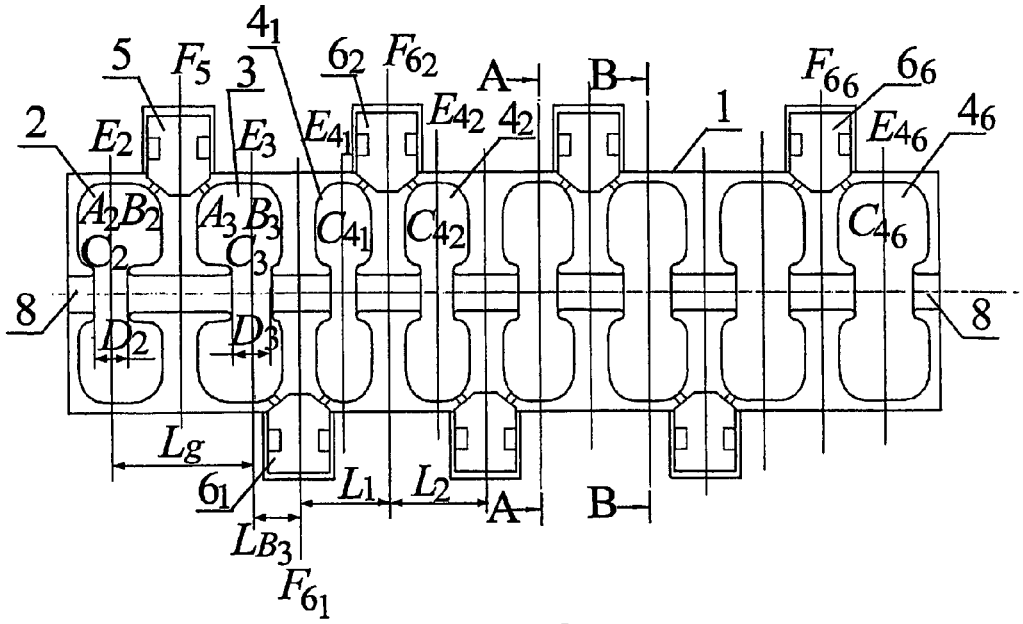
FIG. 2: diagram of accelerating structure with side connection cells as per the invention.

Meantime, connection cells 5 and units $\mathbf{6}_i$ can be internal, as shown on the FIG. 1, or side ones, as shown on the FIG. 2.

Meantime, connection cells 5 and units $\mathbf{6}_i$, as shown on the FIG. 2, are located at 180° shift against one another.

Figure 1A:
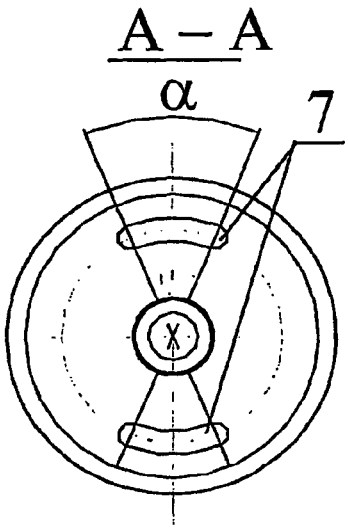
FIG. 1*a*: accelerating unit $\mathbf{4}_3$ of accelerating structure shown at FIG. 2, section A-A at gap center.
Figure 1B:
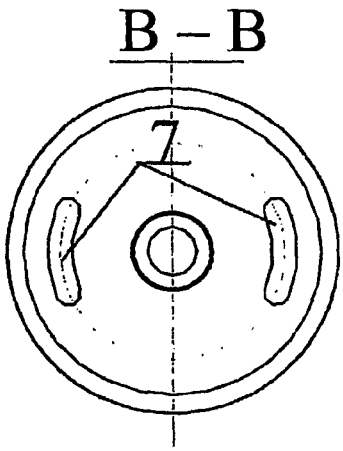
FIG. 1*b*: accelerating unit $\mathbf{4}_4$ of accelerating structure shown at FIG. 2, section B-B at gap center.
Figure 2A:
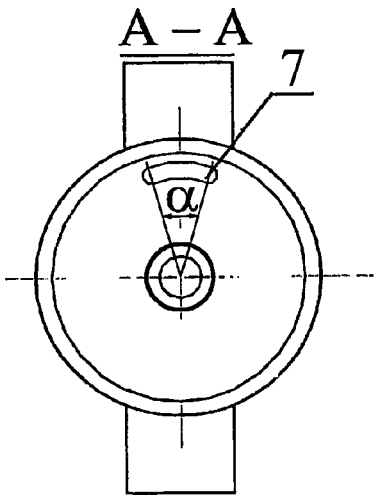
FIG. 2*a*: accelerating unit $\mathbf{4}_3$ of accelerating structure shown at FIG. 3, section A-A at gap center.
Figure 2B:
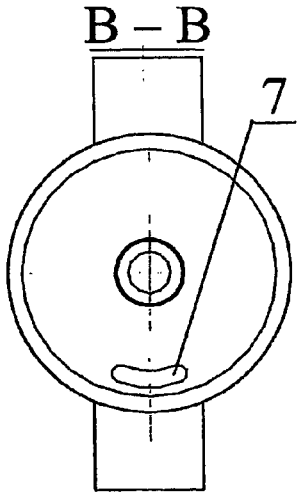
FIG. 2*b*: accelerating unit $\mathbf{4}_4$ of accelerating structure shown at FIG. 3, section B-B at gap center.

Meantime, coupling slots 7 can be executed according to selected fabrication version of connection cells 5 and cells $\mathbf{6}_i$: being combined with internal cells 5 and $\mathbf{6}_i$, two antipodal slots at each of the two walls of accelerating units, excluding the first and the last ones, where coupling slots are located at only one wall (FIG. 1, FIG. 1*a*, FIG. 1*b*), or, being combined with connection cells 5 and cells $\mathbf{6}_i$, one slot per each of the two walls of accelerating units, excluding the first and the last ones, where coupling slots are located at only one wall (FIG. 2, FIG. 2*a*, FIG. 2*b*).

Meantime, in accelerating structures 1 and 1' with internal connection cells 5 and $\mathbf{6}_i$ (FIG. 1), in order to reduce the influence of lateral components of electromagnetic field onto the axes, arising due to field distribution deterioration because of coupling slotting, and onto accelerated bunch dynamics, its reasonable that in accelerating units 2, 3 and $\mathbf{4}_i$ of slots pair 7 on opposite walls the units are located diametrically (FIG. 1*a*), and in cells 5 and $\mathbf{6}_i$ of slots pair 7 they should be turned at the angle of 90° against to one another. In accelerating structures 1 or $\mathbf{1}_1$ with side cells 5 and $\mathbf{6}_i$ (FIG. 2), coupling slots 7 at opposite walls are turned at the angle of 180° according to position of side connection cells 5 and $\mathbf{6}_i$.

Channel 8 is located along the axis of accelerating structure 1 and $\mathbf{1}_1$ for passage of a bunch of accelerated particles.

Bunch resonator 2 (FIG. 2, 3) is made of two parts; first of them $A_2$ and second $B_2$ have internal cavities facing towards each other and forming a common internal cavity $C_2$ of the bunch resonator 2.

Booster resonator 3 (FIG. 1, 2) is also made of two parts; first of them $A_3$ and second $B_3$ have internal cavities facing towards each other and forming a common internal cavity $C_3$ of the booster resonator 3.

In order to provide maximal possibility of optimal gap width $D_2$ and resonators' soundness $D_3$ and, thereby, to gain the reduction of high-frequency power losses to make grouping and create accelerating fields, as well as to reduce thermal load and increase voltages on the gap $D_3$ of booster resonator 3, bunch resonator 2 and booster resonator 3 have internal cavities $C_2$ and $C_3$, respectively, which are asymmetric against the centers $E_2$ and $E_3$ of accelerating gaps $D_2$ and $D_3$ of bunch resonator 2 and booster resonator 3, respectively.

According to the invention, optimal distance $L_g$ between the gaps $E_2$ and $E_3$ and optimal voltage $U_g$ in the gap of bunch resonator 2 should be selected in accelerating structure 1, as well as in the first section of multi-sectional accelerating structure $\mathbf{1}_1$.

According to known theory of klystron grouping (I. V. Lebedev, Microwave apparatus and devices, Moscow, 1970, $2^{nd}$ edition. Vol. 1 and 2.), when approaching infinitely narrow gap and neglecting the effects of charge cloud, the relation of amplitude of harmonically altered voltage $U_g$ at the gap of bunch resonator 2 (FIG. 1, 2) to the voltage $U_o$ of electron source, providing max. amplitude of first harmonic of circulating current at the distance $L_g$ from the center $E_2$ of gap $D_2$ of bunch resonator is given by the following relation:

$$\frac{U_g}{U_0} = \frac{x_1^1 \beta_0 \lambda}{\pi L_g} \tag{1}$$

where $x_1^1 \approx 1.84$ is position of the first maximum of first order Bessel function, $\lambda$ is microwave field wavelength in free space, $\beta_0 = v_0/c$, where $v_0$ is velocity of electron stream at the output of electrons source, and c is light velocity. Please note, that $$\beta_0 = \sqrt{1 - \left(\frac{em_0c^2}{em_0c^2 + U_0}\right)^2},$$

where $m_0$ rest mass and e is electron charge.

Figure 3:
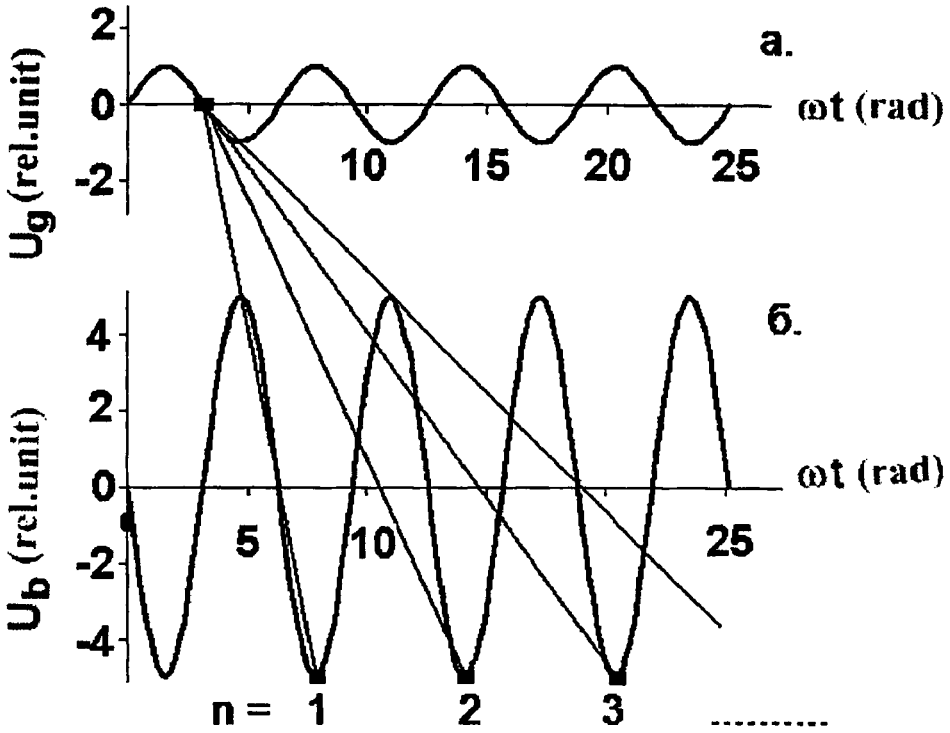
FIGS. 3*a* and 3*b*: graphs of voltage change at the gap of bunch resonator and booster resonator, respectively.

FIG. 3*a*, 3*b* show the graphs of voltage change at the gap of bunch resonator 2 (FIG. 3*a*) and booster resonator 3 (FIG. 3*b*) for the version of accelerating structure according to the invention.

When plotting the graphs, it is considered that phase difference of accelerating field in adjacent units is equal to 180°.

It is known from the theory of klystron grouping that electrons are grouped into bunches against an electron passed the gap center of bunch resonator, when the sign of electromagnetic field changes from positive to negative one. That's why, in order to provide maximal factor of particles capture into acceleration mode, electrons passed the gap center $E_2$ of bunch resonator 2, when the accelerating field sign in the gap changes from positive to negative, should also pass the gap center $E_3$ of booster resonator 3 in the moment, when accelerating field has maximal negative value.

Straight lines on the FIGS. 3*a* and 3*b* show possible temporary relation between the passage through the gap $E_3$ center of booster resonator 3. Therefore, minimal time interval between gap $E_2$ center passage of bunch resonator 2 and gap $E_3$ center passage of booster resonator 3 should be ¾ from accelerating field period, and it can be increased multiple of microwave field period at the expense of the distance $L_g$ between gap centers $E_2$ and $E_3$. Therefore, the value of $L_g$ is defined by the following:

$$\frac{L_g}{\beta_0} = \frac{4n-1}{4}\lambda \tag{2}$$

where n=1, 2, 3 . . . specifies the number of integer periods minus one period of accelerating structure, during which the particles move between gap centers of bunch resonator 2 and booster resonator 3.

By substituting the expression (2) into expression (1), we will acquire:

$$\frac{U_g}{U_0} \approx \frac{7.36}{\pi(4n-1)} \tag{3}$$

Therefore, the ratios $$\frac{U_g}{U_0} \approx 0.781, 0.335, 0.213 \ldots,$$

respectively, and they don't depend on wavelength for any value of n=1, 2, 3 . . . .

Selection of n-value can be justified by following considerations.

As far as n-value increases, the distance $L_g$ between the centers $E_2$ and $E_3$ of gaps $D_2$ and $D_3$ of bunch resonator 2 and booster resonator 3, respectively, is also increased and voltage $U_0$ at the gap $D_2$ on bunch resonator is reduced.

The increase of $L_g$ enables to increase the volume and, hence, the stored energy and resonator soundness, but it results in increase of accelerating structure length and impacts of spurious fields, as well as complicates the solution of bunch focusing problem and the settling process of accelerating structure.

In order to prevent particles de-grouping after they pass booster resonator 3, it is necessary to satisfy the condition $U_g \ll U_b$, where $U_b$ is the voltage across the gap of booster resonator 3. However, providing of very low voltage across the gap of bunch resonator 2 may constitute a problem due to limited fabrication accuracy of accelerating structure and measuring of accelerating field distribution. Considering the above-stated, n=2 will be a compromising value.

All following accelerating units $\mathbf{4}_i$ are made symmetric against the centers of accelerating gaps $E_{4i}$, I=1, 2, . . . , K (FIG. 1, 2). To provide synchronization of accelerated particles with electromagnetic field, the particles should pass the distance from the center $E_{6i}$ of connection cell $\mathbf{6}_i$ up to the center $E_{6i+1}$ of connection cell $F_{6i+1}$ at a time equal to the half of accelerating field period t=T/2. This condition may be stated as follows:

$$\frac{L_i}{\bar{v}_i} = \frac{T}{2}, \tag{4}$$

where $L_i$ is the length of accelerating structure segment located between the centers of adjacent connection unit, including accelerating unit $\mathbf{4}_i$; $v_i$ is average particles velocity within the said segment of accelerating structure; i=1, 2, . . . K. This condition may be stated as follows:

$$\frac{L_{i+1}}{L_i} = \frac{\bar{v}_i}{\bar{v}_{i+1}}, \tag{5}$$

i.e., the length of each following segment of accelerating structure relates to that for the previous segment of accelerating structure, as the average electron velocity at the previous segment relates to that at the following segment.

As far as kinetic energy of accelerated particles grows and their velocities approach to light velocity, the length of specified segment, as it can be seen from the formula (4), approaches to the half of accelerating field wavelength. If kinetic energy of the particles exceeds the rest energy, than the difference of adjacent segments' lengths becomes insignificant and, in order to simplify the accelerating structure fabrication and reduce its cost, it is reasonable to group individual segments with the same length. According to the invention, the length of individual segment in group and number of segments are determined from the condition that phase shift of accelerating structure against accelerating field after segment group passage, doesn't exceed $10^0$.

The length $L_{B3}$ of segment located between the center of booster resonator 2 and the center of connection cell 5 is selected from the condition of approximate time equality of particle movement across the quarter-period of specified segment of accelerating field:

$$\frac{L_{B_3}}{\bar{v}_{B_3}} \approx \frac{T}{4}, \tag{6}$$

where $v_{B3}$ is average particles velocity within specified segment.

As far as average particles velocities $v_i$, i=1, 2, . . . K, $v_{B3}$ in formulas (4)-(6) are not known in advance and they are the functions of target lengths $L_i$, i=1, 2, . . . K and $L_{B3}$, as well as they depend on relative electromagnetic field distribution between accelerating units and common field level in accelerating structure, the target lengths are defined using iteration procedure including numeric calculations of electrodynamic parameters of accelerating structures and bunch dynamics by well-known software according to known techniques described in publications (Vetrov A. A., Calculation of electrodynamic parameters and optical properties of accelerating structures in wide wavelengths range. Thesis for Cand. Sc. degree. Moscow. Research and Development Institute of Nuclear Physics, Moscow State University, 2005, 138 pgs.)

According to the formula (3), voltage magnitude across the gap of bunch resonator 2 (FIG. 1, 2) and voltage magnitude across the gap of booster resonator 3 (FIG. 1, 2), providing the increase of relative particles velocities up to $\beta \geqq 0.4 \div 0.5$ are achieved by selecting the angles of slots 7 openings as per known technique described in publications (Zverev B. V., Sobenin N. P. Electrodynamic parameters of accelerating resonators. Moscow, 1993, Energoatomizdat, 240 pgs.).

According to this invention, implementation of electrons acceleration with low initial energy using the accelerating structure as described herein, may be illustrated in continuous linear accelerator with standing wave; refer to the version on FIGS. 4*a*, 4*b*, 4*c*, 5*a*, 5*b*, 5*c*, 6*a*, 6*b*, 6*c* and 6*d*. Form of connecting lines on these Figures mean as follows: heavy solid lines show the propagation of high-voltage signal, fine solid lines show the propagation of high-frequency signal, heavy dotted lines show the impact of devices by mechanical reset of magnetrons frequencies, and fine dotted lines show the propagation of low-frequency signals for controlling of different high-frequency devices.

Figure 4A:
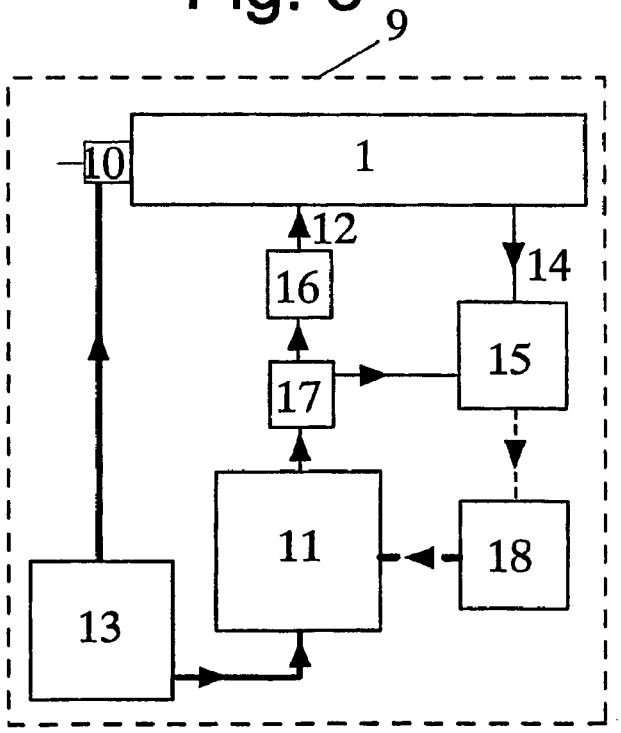
FIGS. 4*a*, 4*b* and 4*c*: diagram of one-sectional continuous linear accelerator with standing wave and low-injection energy according to this invention.
Figure 4B:
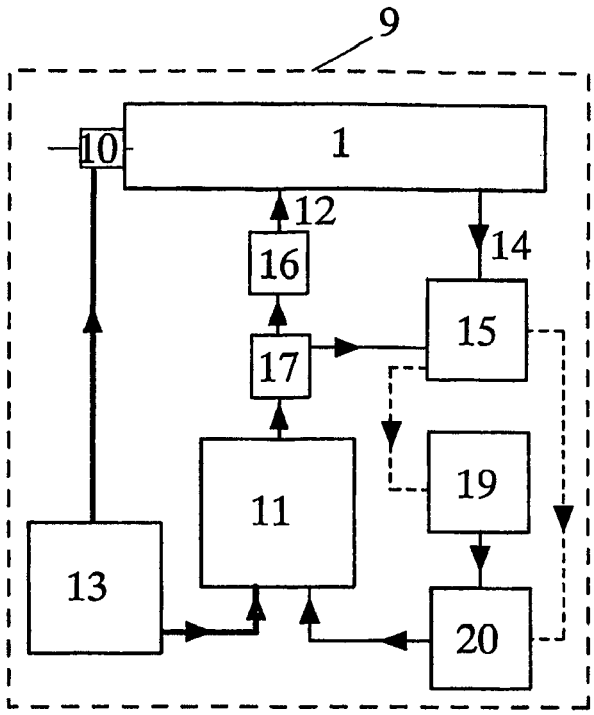
Figure 4C:
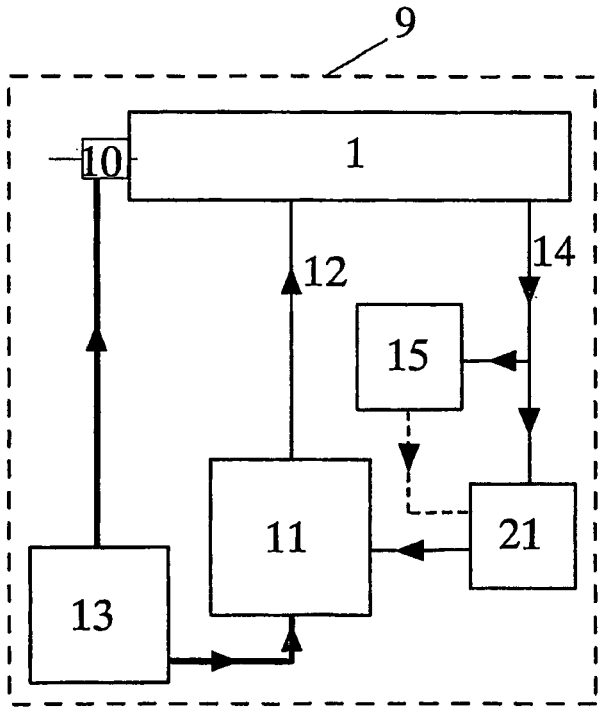

FIGS. 4*a*, 4*b*, and 4*c* show the versions of continuous linear accelerator with standing wave contained one-sectional accelerating structure according to this invention.

Linear accelerator 9 (FIGS. 4*a*, 4*b*, and 4*c*) contains: accelerating structure 1 executed as per one of the above-described versions according to this invention; the source of electrons with low energy, e.g., electron gun 10 installed directly onto the input of accelerating structure 1; high-frequency power source 11 for feeding of acceleration structure via wave-guide duct 12, high-voltage rectifier 13 for feeding of high-frequency power source 11 and electron gun 10; receiving antenna 14 located in one of accelerating units of the said accelerating structure 1 and adopted for acquisition of high-frequency signal in order to monitor amplitude and phase of accelerating field; monitoring device 15, which arrangement and functions depend on concrete implementation of high-frequency feeding.

Electron gun providing output electron beam with energy of 10 to 20 keV can be used as electron gun 10.

Continuous magnetron can be used as microwave power source, as is shown on the FIG. 4*a*. In this case decoupler 16 providing magnetron protection from high-frequency signal reflected from accelerating structure 1 is located between accelerating structure 1 and magnetron 11, and directional coupler 17 providing the acquisition of high-frequency signal for monitoring of amplitude and phase at the output of magnetron 11. Controlling device 15 includes amplitude and phase detector and, based on the signal of receiving antenna 14 and the signal of directional coupler 17, provides monitoring of mechanical control of magnetron 11 operating frequency.

Continuous klystron externally excited by driving generator 19 with configurable frequency, as is shown on the FIG. 4*b*. In this case decoupler 16 providing klystron protection from high-frequency signal reflected from accelerating structure 1, is located between accelerating structure 1 and magnetron 11, and directional coupler 17 providing the acquisition of high-frequency signal for monitoring of amplitude and phase at the output of magnetron 11. Controlling device 15 includes amplitude and phase detector and, based on the signal of receiving antenna 14 and the signal of directional coupler 17, provides generator control and amplitude monitoring of high-frequency signal at the input of klystron using the device 20.

Continuous klystron operated with self-oscillation in accelerating structure in a feedback circuit, as is shown on the FIG. 4*c*. In this case control 15 contains amplitude detector and, based on the signal of receiving antenna 14, provides amplitude and phase monitoring of high-frequency signal at the input of klystron using the device 21. In this case accelerator can work without decoupler, as far as self-oscillating frequency automatically follows resonance frequency of accelerating structure 1, providing minimal reflected wave; if high-frequency breakdown arises in accelerating unit or wave-guide duct, then attenuation of feedback circuit signal increases, and self-oscillating stops.

Figure 5A:
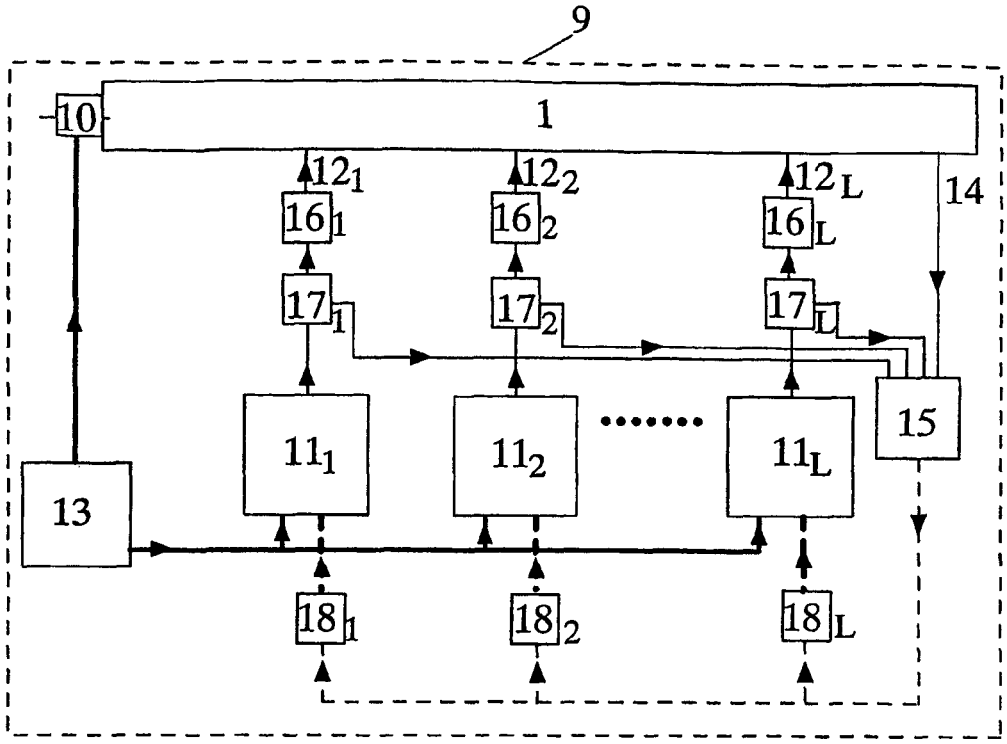
FIGS. 5*a*, 5*b* and 5*c*: diagrams of one-sectional continuous linear accelerator according to this invention, incorporating several high-frequency power sources.
Figure 5B:
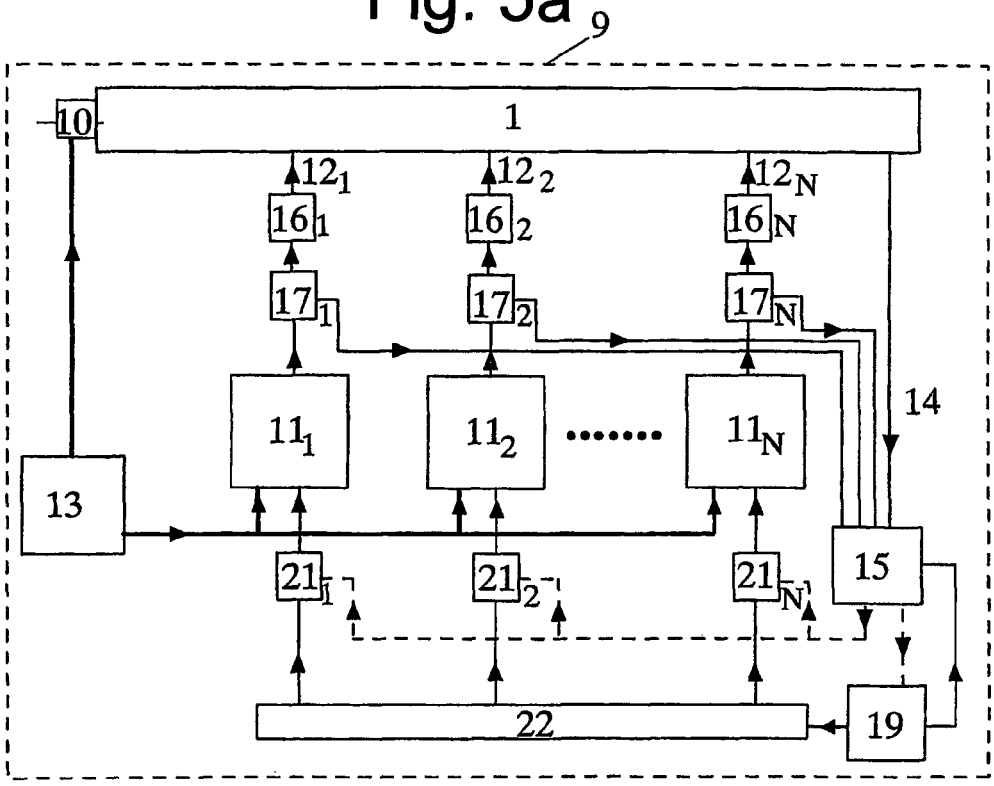
Figure 5C:
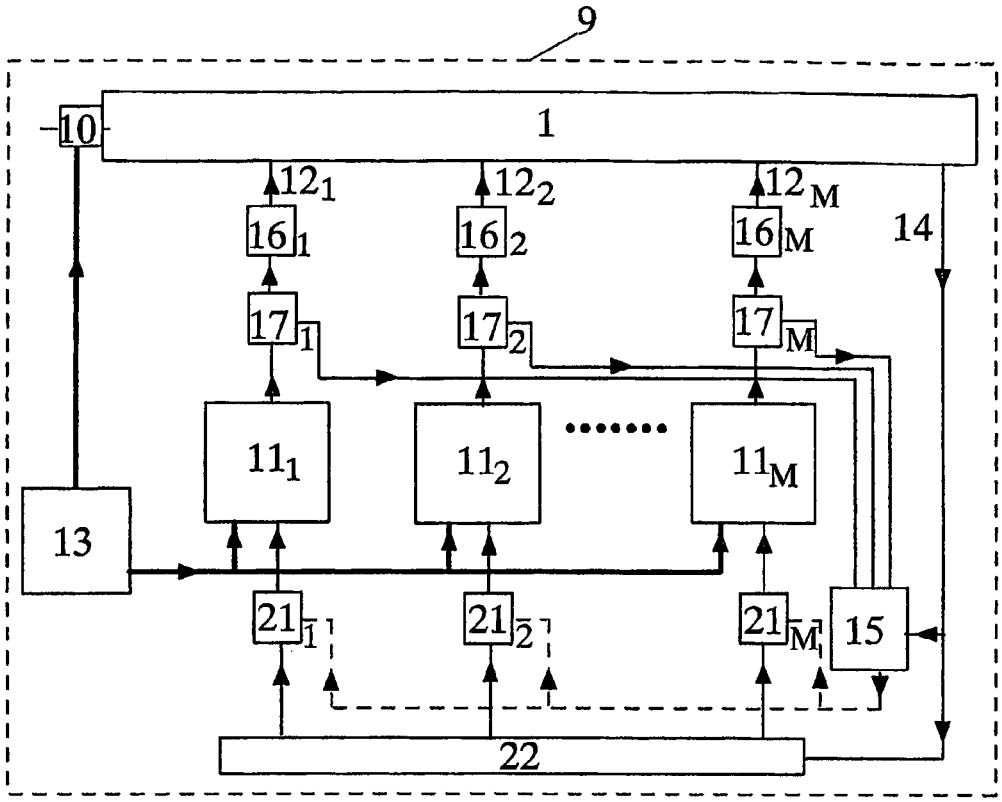

According to this invention, linear accelerator 9, containing one-sectional accelerating structure 1, can include several high-frequency power sources 11, as is shown on FIGS. 5*a*, 5*b* and 5*c*. This version of accelerator arrangement is preferable in the case, when the power of one source is not enough for reaching required energy or power of accelerated bunch, and integer number of accelerating units, necessary for reaching the design power, is relatively small (below 25-30). Decoupler 16, preventing the source damage by high-frequency signal, is located between accelerating structure 1 and high-frequency power source 11, and directional coupler 17 providing the acquisition of high-frequency signal for monitoring of amplitude and phase is located at the source output. Linear accelerator 9 contains receiving antenna 14 located in one of accelerating units of accelerating structure 1 and adopted for acquisition of high-frequency signal for monitoring of amplitude and phase of accelerating field, and controlling device, which arrangement and functions depend on concrete implementation of high-frequency feeding.

FIG. 5*a* shows the version of linear accelerator 9 implemented according to this invention and having one-sectional accelerating structure 1, in which L magnetrons are used as high-frequency power sources $\mathbf{11}_1, \mathbf{11}_2, \ldots, \mathbf{11}_L$. In this case controlling device 15 includes amplitude and phase detectors and, based on the signal of receiving antenna 14 and the signal of directional couplers $\mathbf{17}_1, \mathbf{17}_2, \ldots, \mathbf{17}_L$, provides mechanical frequency re-setting for all L magnetrons using mechanical controls $\mathbf{18}_1, \mathbf{18}_2, \ldots \mathbf{18}_L$. Synchronization of L magnetrons in this diagram is provided by the signal of electromagnetic field generated by accelerated bunch in accelerating structure 1, and entering to the outputs of magnetrons $\mathbf{11}_1, \mathbf{11}_2, \ldots, \mathbf{11}_L$ via wave-guide ducts $\mathbf{12}_1, \mathbf{12}_2, \ldots, \mathbf{12}_L$ and decouplers $\mathbf{16}_1, \mathbf{16}_2, \ldots, \mathbf{16}_L$ and superimposed by the signal of high-frequency field excited by high-frequency power sources $\mathbf{11}_1, \mathbf{11}_2, \ldots, \mathbf{11}_L$, in this case by magnetrons, in accelerating structure 1.

FIG. 5*b* shows the version of one-sectional linear accelerator 9 implemented according to this invention, in which N klystrons, excited by eternal driving generator 19 with configurable frequency, are used as high-frequency power sources $\mathbf{11}_1, \mathbf{11}_2, \ldots, \mathbf{11}_N$. In this case controlling device 15 includes amplitude and phase detectors and, based on the signal of receiving antenna 14 and the signal of directional couplers $\mathbf{17}_1, \mathbf{17}_2, \ldots, \mathbf{17}_N$, via power splitter 22, provides frequency regulation of driving generator 19, as well as provides phase and frequency monitoring of high-frequency signals at the inputs of klystrons using controlling devices $\mathbf{21}_1, \mathbf{21}_2, \ldots, \mathbf{21}_N$. Synchronization of klystrons in this diagram is provided by the signal of driving generator 19 common for all klystrons.

FIG. 5*c* shows the version of one-sectional linear accelerator 9 implemented according to this invention, in which M klystrons, excited by self-oscillator, are used as high-frequency power sources $\mathbf{11}_1, \mathbf{11}_2, \ldots, \mathbf{11}_M$. In this case controlling device 15 includes amplitude and phase detectors and, based on the signal of receiving antenna 14 and the signal of directional couplers $\mathbf{17}_1, \mathbf{17}_2, \ldots, \mathbf{17}_M$, provides phase and frequency monitoring of high-frequency signals entering via power splitter 22, using the controlling devices $\mathbf{21}_1, \mathbf{21}_2, \ldots \mathbf{21}_N$. Klystrons in this diagram are synchronized by the signal of receiving antenna 14 common for all klystrons.

According to this invention, linear accelerator 9 can includes accelerating structure 1' with one or several accelerating sections $\mathbf{1}_j$ at j=1, 2, . . . , each of them fed from separate high-frequency power source 11*j*, as is shown on FIGS. 6*a*, 6*b*, 6*c* and 6*d*, and contains receiving antenna $\mathbf{14}_j$ located in one of accelerating units of the said accelerating section 1'.

This version of accelerator's arrangement is needed, when integer number of accelerating units required for reaching the design energy in one-sectional accelerator, is too high (above 25-30). Meantime, according to this invention, starting, at least, from the second section, the segments of accelerating structure located between the centers of units $\mathbf{6}_i$ and $\mathbf{6}_{i+1}$, including accelerating structure $\mathbf{4}_i$ (FIG. 1, 2), have equal lengths and compose a group; and quantity of such segments are such that phase shift of accelerated particle with respect to accelerating field after its passage in a group of segments, doesn't exceed $10^0$.

Figure 6A:
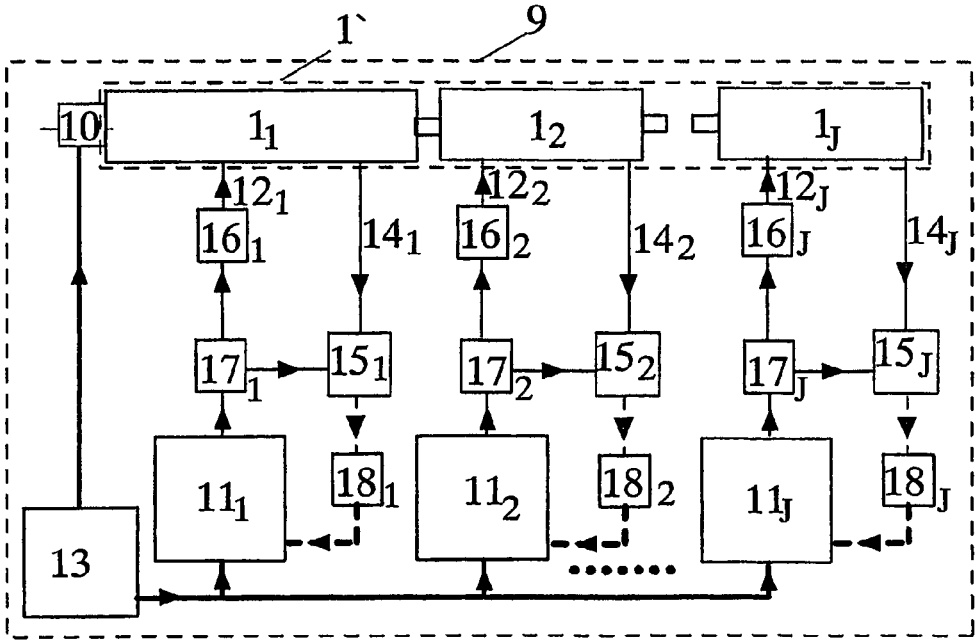
FIGS. 6*a*, 6*b*, 6*c* and 6*d*: diagrams of multi-sectional continuous linear accelerator according to this invention with different ways of high-frequency power supply.

FIG. 6*a* shows the version of linear accelerator 9 implemented according to this invention and having accelerating structure 1' containing J accelerating sections $\mathbf{1}_j$, from which only the first section $\mathbf{1}_1$ is executed according to one-sectional accelerating structure 1 shown at FIGS. 1 and 2; and meantime, each section $\mathbf{1}_1, \mathbf{1}_2, \ldots, \mathbf{1}_j$ is fed from separate high-frequency power sources $\mathbf{11}_1, \mathbf{11}_2, \ldots, \mathbf{11}_j$, respectively, represented by J magnetrons. Between each accelerating structure $\mathbf{1}_1, \mathbf{1}_2, \ldots, \mathbf{1}_j$ and magnetron $\mathbf{11}_1, \mathbf{11}_2, \ldots, \mathbf{11}_j$, there is decoupler $\mathbf{16}_1, \mathbf{16}_2, \ldots, \mathbf{16}_j$, providing magnetron protection from high-frequency signal reflected from accelerating structure, as well as directional coupler $\mathbf{17}_1, \mathbf{17}_2, \ldots, \mathbf{17}_j$, providing the acquisition of high-frequency signal for phase and frequency monitoring at magnetron outputs. In this case controlling devices $\mathbf{15}_1, \mathbf{15}_2, \ldots, \mathbf{15}_j$ include amplitude and phase detectors and, based on the signals of receiving antenna $\mathbf{14}_1, \mathbf{14}_2, \ldots, \mathbf{14}_j$ and the signals of directional couplers $\mathbf{17}_1, \mathbf{17}_2, \ldots, \mathbf{17}_j$, provide mechanical re-setting of magnetrons frequencies, using mechanical controlling devices $\mathbf{18}_1, \mathbf{18}_2, \ldots \mathbf{18}_j$. Magnetrons in this diagram are synchronized by the signal of electromagnetic field generated in accelerating sections $\mathbf{1}_1, \mathbf{1}_2, \ldots, \mathbf{1}_j$ by accelerated bunch and entering to magnetrons outputs via wave-guide ducts $\mathbf{12}_1, \mathbf{12}_2, \ldots, \mathbf{12}_j$ and decouplers $\mathbf{16}_1, \mathbf{16}_2, \ldots, \mathbf{16}_j$. These signals are superimposed by high-frequency signal excited by each magnetron in relevant section of the accelerating structure.

Figure 6B:
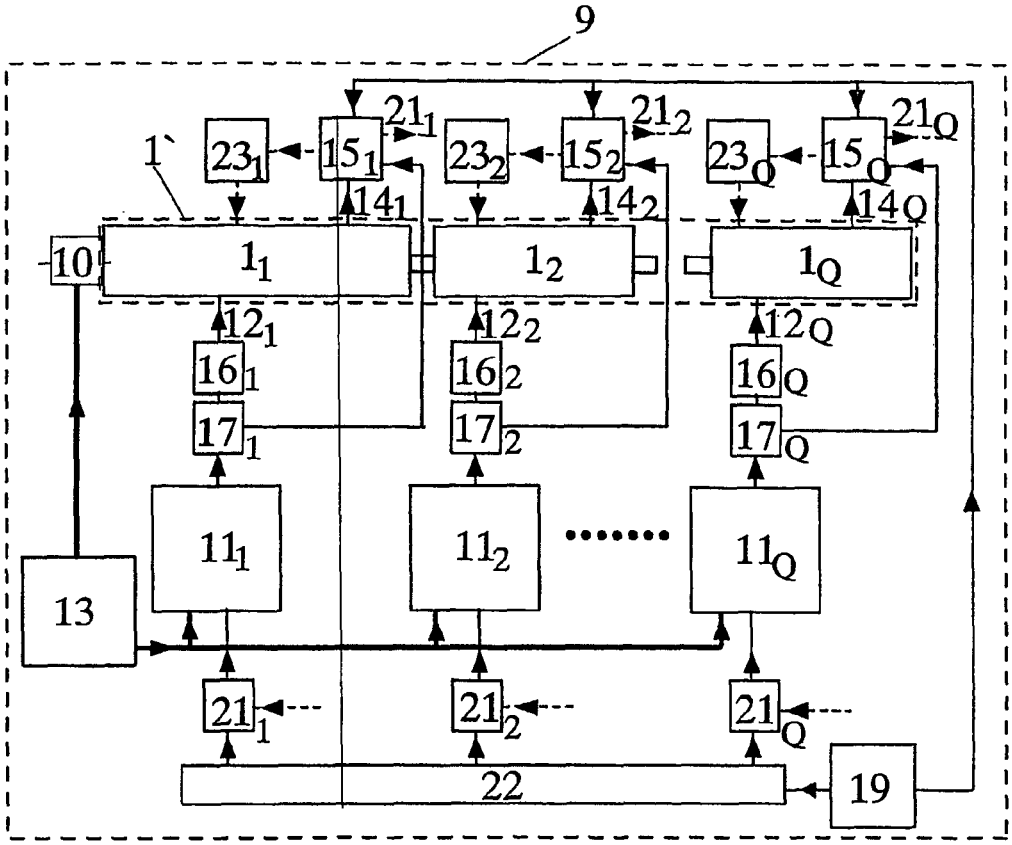

FIG. 6*b* shows the version of linear accelerator 9 implemented according to this invention, and having accelerating structure 1' containing Q accelerating sections $\mathbf{1}_Q$, where Q=1, 2, . . . ; each of these $\mathbf{1}_1, \mathbf{1}_2, \ldots, \mathbf{1}_Q$ is fed from separate high-frequency power sources $\mathbf{11}_1, \mathbf{11}_2, \ldots, \mathbf{11}_Q$, respectively. They are represented by Q klystrons externally excited by high-frequency generator 19 via power splitter 22. Between each accelerating structure $\mathbf{1}_1, \mathbf{1}_2, \ldots, \mathbf{1}_Q$ and klystron $\mathbf{11}_1, \mathbf{11}_2, \ldots, \mathbf{11}_Q$, there is decoupler $\mathbf{16}_1, \mathbf{16}_2, \ldots,$ $16_Q$, providing klystron protection from high-frequency signal reflected from accelerating structure, as well as directional coupler $17_1, 17_2, \ldots, 17_Q$, providing the acquisition of high-frequency signal for phase and frequency monitoring at klystron outputs. In this case controlling devices $15_1$, $15_2, \ldots, 15_Q$ include amplitude and phase detectors and, based on the signals of receiving antenna $14_1, 14_2, \ldots, 14_Q$ and the signals of directional couplers $17_1, 17_2, \ldots, 17_Q$, provide mechanical re-setting of resonance frequencies of accelerating sections $1_1, 1_2, \ldots, 1_Q$, using frequency controls $23_1, 23_2, \ldots 23_Q$, and provide amplitude and phase monitoring of high-frequency signals at klystrons outputs, using controlling devices $21_1, 21_2, \ldots 21_Q$. Mechanically moved plungers introduced inside accelerating units or temperature regulators for liquids cooling the accelerating units, or flow controllers can be used as executors $23_1, 23_2, \ldots 23_Q$ of resonance frequency controls of accelerating sections. Klystrons in this diagram are synchronized by drive high-frequency signal, which is generated by high-frequency generator and is common for all klystrons.

Figure 6C:
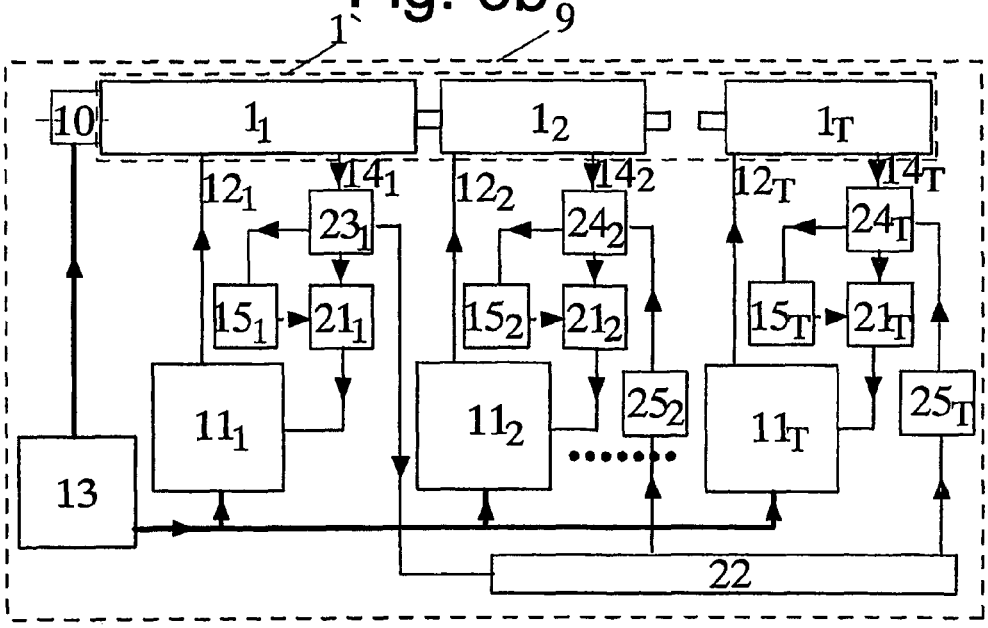

FIG. 6*c* shows the version of linear accelerator 9 implemented according to this invention, and having accelerating structure 1' containing T accelerating sections $1_T$, where T=1, 2, . . . , each of them $1_T$ is fed from separate high-frequency power sources $11_1, 11_2, \ldots, 11_T$, respectively, represented by T self-oscillated klystrons. In this case controlling devices $15_1, 15_2, \ldots, 15_T$ include amplitude detectors and, based on the signals of receiving antenna $14_1, 14_2, \ldots, 14_T$ provide amplitude and phase monitoring of high frequency signals at klystron outputs, using controlling devices $21_1, 21_2, \ldots 21_T$. Klystrons $11_1, 11_2, \ldots, 11_T$ are synchronized high-frequency signal, which is offset from a feedback circuit of the first section $1_1$ using the device $23_1$ and is dithered into feedback circuit for each of the said successive sections via power splitter 22, using the controlling devices $24_2, \ldots, 24_T$. Phases of the accelerating sections fields, providing optimal bunch acceleration, are selected by phase changers $25_2, \ldots, 25_T$ installed between power splitters and high-frequency dithering devices. No decouplers are installed between klystrons $11_1, 11_2, \ldots, 11_T$ and accelerating sections $1_1, 1_2, \ldots, 1_T$.

Figure 6D:
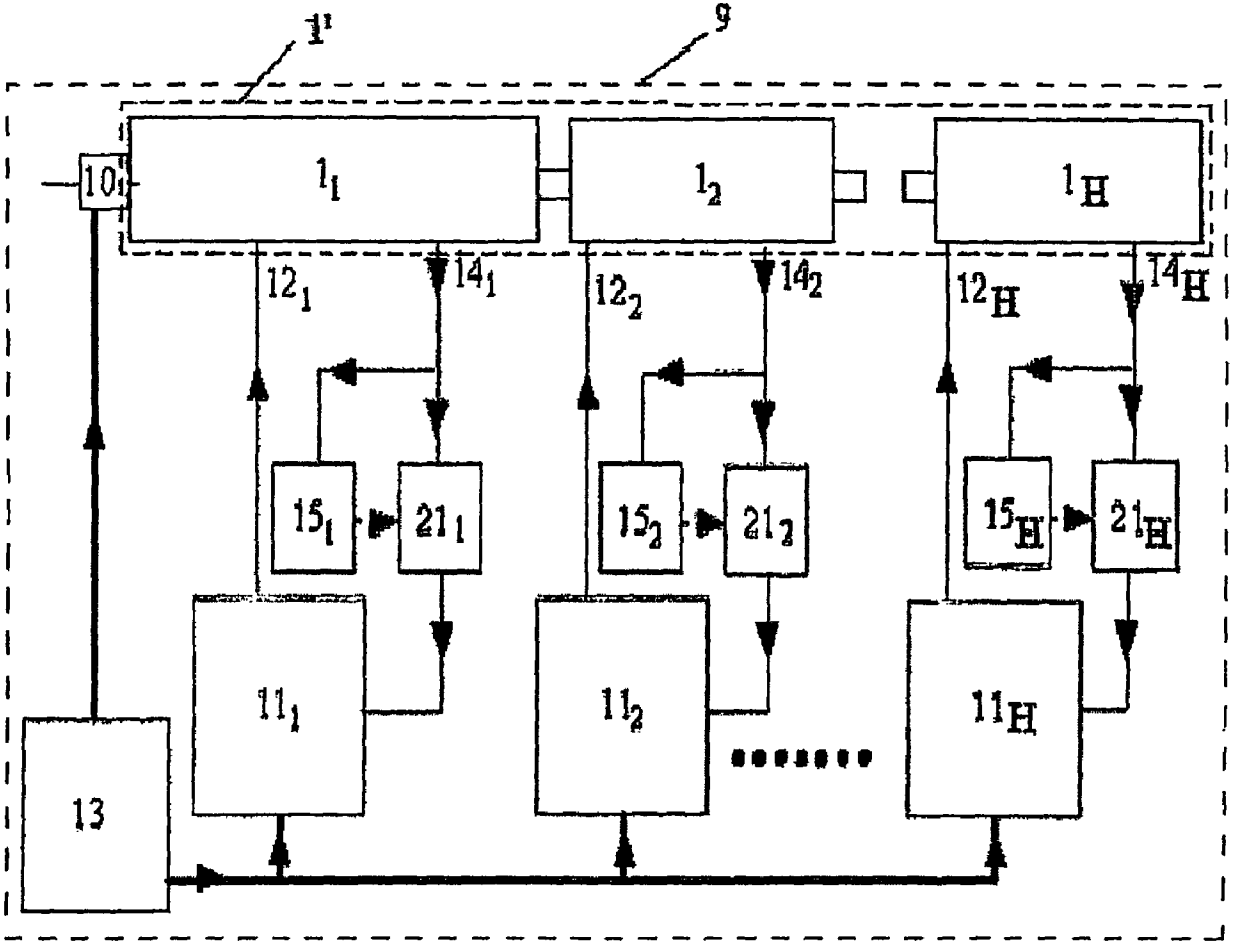

FIG. 6*d* shows the version of linear accelerator 9 implemented according to this invention, and having accelerating structure 1' containing H accelerating sections $1_H$, each of them is fed from separate high-frequency power sources $11_1$, $11_2, \ldots, 11_H$, respectively; and they are represented by H self-oscillated klystrons. In this case controlling devices $15_1$, $15_2, \ldots, 15_H$ include amplitude detectors and high-frequency signal meters and, based on the signals of receiving antenna $14_1, 14_2, \ldots, 14_H$, and the data of energy and accelerated bunch spectrum, provide amplitude and phase monitoring of high frequency signals at klystron outputs, using controlling devices $21_1, 21_2, \ldots 21_H$. Klystrons $11_1, 11_2, \ldots, 11_H$ are synchronized by high-frequency signal generated by accelerated bunch in relevant section and entering to klystrons inputs from the receiving antenna, and superimposed by high-frequency signal in relevant accelerating section $1_1, 1_2, \ldots, 1_H$. No decouplers are installed between klystrons $11_1, 11_2, \ldots, 11_H$ and accelerating sections $1_1, 1_2, \ldots, 1_H$.

Such feeding diagram of high-frequency multi-sectional accelerator is the most simple from those considered; however, it is applicable only at enough high bunch currents. According to this invention, the described diagram of linear accelerator (FIG. 6*d*) is applicable, provided that electron efficiency η, specified as the relation of high-frequency power consumed for bunch acceleration to full power consumption for the whole section, is η>0.5 (D. I. Yermakov, B. S. Ishkhanov, O. V. Chubarov, V. I Shvedunov. Phasing of self-oscillating systems at the expense of bunch interaction with accelerating structure, Moscow, 1994, Research and Development Institute of Nuclear Physics, Moscow State University. 94-7/389).

Meantime, according to this invention, accelerating structures 1 and 1', as per parameters selected for linear accelerator 9, have different number of accelerating units and connection cells with different geometric characteristics and different number of power sources, or will have different number of accelerating sections.

Number of high-frequency power sources for individual sections and number of sections will be defined by concrete requirements to accelerated bunch parameters, mass and dimensional data, accelerator's efficiency, as well as designer's possibilities.

Let us consider concrete examples of calculation of linear accelerator 9 with one-sectional accelerating structure 1 according to this invention.

According to this invention, the number of accelerating units 2, 3, $4_i$, where i=1, . . . , K, and connection cells 5, 6*i*, where i=1, . . . , K, and geometric characteristics and operational modes thereof are optimized with a view of ensuring the required energy and current of accelerated bunch at maximal capture factor.

Hereafter, this invention is clarified by concrete examples of the implementation of accelerating structure 1 and low-energy continuous linear electron accelerator 9 for different values of bunch energy and power at the output of accelerating structure 1.

Authors believe that in below-stated examples of linear accelerator 9 implementation the accelerating structure 1, due to selected angles of slots openings 7, is set so that energy growth in booster resonator 3 and the following accelerating cells will amount to $\Delta E_r$.

Let the power of high-frequency losses, used for accelerating field formation at the length of accelerating structure segment located between the centers of connection cells and including the accelerating unit, and equal to the half of accelerating field wavelength, will be denoted as $P_r$.

Based on experimental data available (Shvedunov V. I., Development and fabrication of continuous linear electron accelerator—injector of slotted microtron. Thesis for Cand. Sc. degree. Moscow. Research and Development Institute of Nuclear Physics, Moscow State University. 1992. 350 pgs), in this case, if energy growth per a unit is constant, then high-frequency power used for accelerating field creation changes in inverse proportion to the length of specified segment of accelerating structure is given by:

$$P_i = P_r\left(\frac{\lambda}{2L_i}\right)^2 \tag{7}$$

High-frequency power consumed for accelerating field formation in booster resonator 3, is considered as equal to Pr. We neglect high-frequency power losses in bunch resonator 2, as the voltage across its gap is next lower order in compare to the voltage across the gap of accelerating unit; respectively, high-frequency power losses for the field formation are 100 times less than power losses in other accelerating units.

Authors believe that wave-guide equipment for high-frequency input into accelerating structure for all cases is set so that we can neglect the power of reflected wave. Full power $P_{tot}$ used for bunch acceleration and accelerating field formation amounts to 90% from max. klystron power $P_{kl}$. The rest 10% include possible power losses in high-frequency duct and bunch power losses during acceleration at the expense of particles sedimentation on the walls of transit channel of accelerating structure.

In the said assumptions bunch power at the output of accelerator, consisting of K accelerating units (bunch resonator 2 and booster resonator 3 are excluded), is equal to:

$$E_{out}=\Delta E_r(K+1)+U_0 \tag{8}$$

In the said assumptions, high-frequency power used for accelerating field formation and dissipated over the walls of accelerating structure is defined as follows:

$$P_w = P_r\left(1+\frac{\lambda^2}{4}\sum_{i=1}^{K} L_i^{-2}\right) \tag{9}$$

Based on the formula (4) the length of i-$^{th}$ segment may be represented as follows:

$$L_i = \frac{\lambda}{2}\overline{\beta}_i \tag{10}$$

where $\overline{\beta}_i$ is average relative particle velocity within i-$^{th}$ segment. In turn:

$$\overline{\beta}_i = \frac{1}{2}\left\{\sqrt{1-\left(\frac{m_0c^2}{m_0c^2+U_0+i\Delta E_r}\right)^2}+\sqrt{1-\left(\frac{m_0c^2}{m_0c^2+U_0+(i+1)\Delta E_r}\right)^2}\right\} \quad i=1,2,\ldots K \tag{11}$$

Bunch power at the output of accelerating structure is $P_{out}=E_{out}\ I_{out}$, where $I_{out}$ is bunch current at the output of accelerating structure. Based on energy conservation law one can write:

$$P_{out}=P_{tot}-P_w \tag{12}$$

and, respectively:

$$I_{out} = \frac{P_{tot}-P_w}{E_{out}} \tag{13}$$

Electron efficiency of accelerator is equal to:

$$\eta = \frac{P_{out}}{P_{tot}} \tag{14}$$

Relations (2), (3), (7)-(14) were taken as calculation basis for concrete versions of an accelerator.

Parameters of concrete version of accelerator are specified by microwave source parameters, bunch energy at the output of accelerator, energy growth per accelerating unit and electrodynamic parameters of accelerating structure, in particular, its effective shunt resistant.

When making calculations, authors have assumed that a structure is fed from continuous klystron operated at 2450 MHz ($\lambda$=0.1224 m) with maximal power $P_{kl}$=50 kW and feed voltage of 15 kV.

Supply voltage of electron gun was selected equal to klystron supply voltage, so that $U_0$=15 kV.

Number of integer periods of accelerating field, when a bunch passes between the centers of booster resonator and bunch resonator, was taken as n=2.

According to this invention, it follows from the formula (3) that $U_g$=5 kV, and from the formula (2) $L_g$=50.7 mm.

Based on wide design and experimental material, the authors have stated that effective shunt resistance $\Delta E_r$ of accelerating structure is such that is equal to 60 keV at Pr=1 kW $\Delta E_r$. (A. S. Alimov, K. A. Gudkov, D. I. Yermakov. PTE No. 5, 1994, pgs 7-22). At other values of $\Delta E_r$, the relation $P_r \sim \Delta E_r^2$ is satisfied.

Table 1 represents the values $P_w$, $P_{out}$, $I_{out}$, $\eta$, as well as the length L of accelerating structure and full number of K+2 accelerating structures (including bunch resonator 2 and booster resonator 3) for $\Delta E_r$=60 keV and 3 values of output power $E_{out}$. Similar values are represented in the Table 2 for $\Delta E_r$=40 keV.

TABLE 1

Parameters for 3 versions of accelerator for $\Delta E_r$ = 60 keV

| $E_{out}$, MeV | $P_w$, kW | $P_{out}$, kW | $I_{out}$, mA | $\eta$, % | L, m | K + 2 |
|---|---|---|---|---|---|---|
| 0.555 | 16.0 | 29.0 | 52.2 | 64.4 | 0.492 | 10 |
| 0.975 | 24.4 | 20.6 | 21.1 | 45.7 | 0.883 | 17 |
| 1.455 | 33.2 | 11.8 | 8.1 | 26.2 | 1.35 | 25 |

TABLE 2

Parameters for 3 versions of accelerator for $\Delta E_r$ = 40 keV

| $E_{out}$, MeV | $P_w$, kW | $P_{out}$, kW | $I_{out}$, mA | $\eta$, % | L, m | K + 2 |
|---|---|---|---|---|---|---|
| 0.575 | 11.8 | 33.2 | 57.8 | 73.8 | 0.718 | 15 |
| 0.975 | 17.1 | 27.9 | 28.6 | 62.1 | 1.278 | 25 |
| 1.455 | 23.4 | 21.6 | 14.4 | 48.0 | 2.038 | 38 |

Based on the formula (4) we assess: $L_{B_3}\approx$13.5 mm for $\Delta E_r$=60 keV and $L_{B_3}\approx$12.0 mm for $\Delta E_r$=40 keV.

Please note that considered version of accelerating structure with constant energy growth per unit is not the only one possible and it is selected in this case just because of simplicity of estimated calculations.

One may consider the versions with constant power of high-frequency losses in accelerating units and different combinations thereof. In any case final selection of accelerating structure geometry for concrete application may be done only after detailed iteration calculations of electrodynamic characteristics of accelerating structure and bunch dynamics. Accelerating structure design may have several successively installed sections.

Application of this invention in continuous linear accelerators with standing wave enables to reach the following results:

1. Spurious bunch losses at electron gun are reduced in proportion to injection energy reduction and capture factor increase. E.g., the power of spurious losses reduces from 10 kW to 1 kW for process accelerator with average bunch power of 50-100 mA, i.e. reduces 10 times.

Small power losses reduce walls heating of accelerating structure by electron beam, whereby units deformation also reduces; vacuum conditions improve and, therefore, service life of electron gun cathode is increased and vacuum system of accelerator is simplified.

Besides this, linear accelerator efficiency increases, as well as accelerating structure radiation background reduces, therefore, diminishing the mass of local radiation protection, if accelerator is installed in working premises.

2. Reduction of electron gun supply voltage up to the voltage of continuous microwave power source (10-30 kW depending on source type) enables to use one high-voltage rectifier for feeding both gun and source, therefore, significantly reducing dimensions and cost and simplifying the diagram of high-voltage supply.

3. The use of bunch resonator within accelerating structure enables installation of electron gun directly at the input of accelerating structure that significantly reduces the length of linear accelerator. Besides this, reduction of electrons' supply voltage from 60-80 kV to 10-20 kV also enables to diminish dimensions of linear accelerator.

Therefore, when accelerating electrons with low initial energy in accelerating structure as per this invention, total reduction of accelerator length can be around 0.5 m, i.e., accelerator length for energy 0.5 MeV can be reduced nearly twice in compare to accelerator used the external grouping.

Accordingly, low-energy continuous linear electron accelerator with standing wave can be implemented in different designs providing acceleration of low-energy electrons up to required velocities and electrons energy buildup up to required values.

Meantime, according to this intention, geometric parameters of units, groups and sections of an accelerating structure, as well as electromagnetic field modes and methods of providing thereof can be optimized as per required parameters of output electronic bunch of an accelerator, and cost-effectiveness requirements.

Based on the above, physicists should understand the uniformity and diversity in processes performed in different versions of low-energy continuous linear electron accelerator according to this invention. Meantime, it is important that the possibility occurs to modify the designs of linear accelerators with due account of their applicability in technological processes for different sciences and industries.

Application of linear accelerators according to this invention, in compare to directly operated accelerators, is particularly profitable, when there is a necessity to provide compactness and low weight of a plant and increase its reliability, as well as simplify the requirements to accelerators' operation and avoid expensive overhaul of specialized buildings.

INDUSTRIAL APPLICABILITY

Low-energy continuous linear electron accelerators with standing wave proposed in this invention can make use in different technological processes, in particular, in linking of polyolefin cable insulation, in production of reinforced and shrinkable films, tubes and fabricated parts, in polyethylene and polypropylene foams production, in curing of elastomers and products thereof (tire parts, silicone rubber for fabrication of thermal-resistant self-adhering insulation bands and rubber-glass fabric, rubber gloves and other products).

Beside this, accelerators can be used for solving of environmental tasks (wastewater treatment, flue gases and tunnel-exhaust gases treatment), for treatment of associated gas on oil fields, and for conducting studies in radiation chemistry and other branches of science and industry.

Low-energy continuous linear electron accelerators with standing wave and devices used therein can be fabricated using well-known materials and know-how.

The invention claimed is:

1. Low-energy continuous linear electron accelerators with standing wave, including:

low-energy electron source (10);

accelerating structure (1) for accelerating of low-energy electrons;

high-frequency power source (11) feeding the said accelerating structure (1);

power supply (13) feeding the said electron source and power source;

receiving antenna (14) located in one of accelerating units of the said structure (1) and adopted for acquisition of high-frequency signal for amplitude and phase monitoring of accelerating field;

and, in the meantime, the said accelerating structure (1) includes successively arranged accelerating units (2, 3, 4$_i$) adopted for formation of electromagnetic field under the source of high-frequency power (11), where each previous accelerating structure is connected to the following accelerating structure by coupling slots (7) through connection cells (5, 6$_i$), and in the said accelerating structure:

first accelerating structure is implemented in the form of bunch resonator (2) adopted for direct communication with low-energy electrons source (10), second accelerating structure is implemented in the form of booster resonator (3) adopted for energy increase of incoming electrons up to the values providing their acceleration in the following part of accelerating structure (1), structures following after the second accelerating structure (4$_i$) are adopted to increase the energy of entering electrons up to required value and, at least, for accelerating structures, to which non-relativistic electrons enter with kinetic energy less than rest energy, the lengths ($L_i$) between the centers of adjacent connection cells (5, 6$_i$) of accelerating structure (1) including the said accelerating unit (4$_i$), are selected so that the length ($L_i$) of each following segment of the said accelerating structure (1) relates to that in the previous segment, as the average electron velocity in the previous segment to that in the following segment;

the distance $L_g$ between the gap centers of bunch resonator (2) and booster resonator (3) is selected according to velocity $v_0$ of electron stream at the input to bunch resonator (2) and microwave field wavelength $\lambda$ of high-frequency power source in free space, based on the following relation:

$$\frac{L_g}{\beta_0} = \frac{4n-1}{4}\lambda,$$

where $\beta_o = v_o/c$, c is light velocity, n=1, 2, 3 . . . , and voltage $U_g$ at the gap of bunch resonator (2) is selected from relation $$\frac{U_g}{U_0} \approx \frac{7.36}{\pi(4n-1)},$$

where $U_o$ is electron source voltage, n=1, 2, 3 . . . .

2. Accelerator specified in claim 1, but distinguished by the fact that accelerating units in accelerating structure (1) providing acceleration of electrons with kinetic energy above the rest energy enables to further increase electron energy; meantime, the length ($L_i$) of individual segment in group and their numbers are selected from the condition, that phase shift of accelerated particle with respect to accelerating field after its passage in a group of segments, doesn't exceed $10^0$.

3. Accelerator specified in claim 1, but distinguished by the fact that in the said accelerating structure accelerating units (2,3, $4_i$) are interconnected to each other by internal or side connection cells (5, $6_i$).

4. Accelerator specified in claim 1, but distinguished by the fact that it contains electrons source (10) with injection energy within the range of 10-20 keV.

5. Accelerator specified in claim 1, but distinguished by the fact that it contains electron gun (10) with thermal cathode and two or more electrodes, as a source of electrons.

6. Accelerator specified in claim 1, but distinguished by the fact that it contains magnetron as a source of high-frequency power (11) further including:

device (15) providing mechanical control of magnetron operating frequency;

decoupler (16) providing magnetron protection from high-frequency signal reflected from the accelerating structure (1);

directional coupler (17) providing the acquisition of high-frequency signal for amplitude and phase control of magnetron outputs;

mechanical control (18) of magnetron operating frequency.

7. Accelerator specified in claim 1, but distinguished by the fact that it contains klystron, externally excited from high-frequency driving generator (19) with configurable frequency, as a source of high-frequency power (11) further including:

device (15) for controlling of the said generator (19) and amplitude monitoring (20) of high-frequency signal at klystron input;

decoupler (16) providing klystron protection from high-frequency signal reflected from the accelerating structure (1);

directional coupler (17) providing the acquisition of high-frequency signal for amplitude and phase control of klystron output;

amplitude monitor (20) of high-frequency signal at klystron input.

8. Accelerator specified in claim 1, but distinguished by the fact that it contains klystron, excited by self-oscillator with accelerating structure (1) in a feedback circuit, as a source of high-frequency power (11) further including:

device (21) for amplitude and phase monitoring of high-frequency signal at klystron input;

amplitude monitor (15) of high-frequency signal at klystron input.

9. Low-energy continuous linear electron accelerators with standing wave, including:

low-energy electron source (10);

accelerating structure (1) for accelerating of low-energy electrons;

several high-frequency power sources ($11_1$, . . . , $11_L$) feeding the said accelerating structure (1); each of them is connected with accelerating structure (1) via decoupler ($16_1$, . . . , $16_L$) and directional coupler ($17_1$, . . . , $17_L$);

power supply (13) feeding the said electron source and poser source (10) and the said power sources ($11_1$, . . . , $11_L$);

receiving antenna (14) located in one of accelerating units of the said structure (1) and adopted for acquisition of high-frequency signal for amplitude and phase monitoring of accelerating field;

and, in the meantime, the said accelerating structure (1) includes successively arranged accelerating units (2, 3, $4_i$) adopted for formation of electromagnetic field under the sources of high-frequency power ($11_1$, . . . $11_L$), where each previous accelerating structure is connected to the following accelerating structure by coupling slots (7) through connection cells (5, $6_i$), and in the said accelerating structure (1):

first accelerating unit is implemented in the form of bunch resonator (2) adopted for direct communication with low-energy electrons source (10), second accelerating unit is implemented in the form of booster resonator (3) adopted for energy increase of incoming electrons up to the values providing their acceleration in the following part of accelerating structure, units following after the second accelerating unit ($4_i$) are adopted to increase the energy of entering electrons up to required value and, at least, for accelerating structures, to which non-relativistic electrons enter with kinetic energy less than rest energy, the lengths ($L_i$) between the centers of adjacent connection cells (5, $6_i$) of accelerating unit (1), including the said accelerating unit ($4_i$), are selected so that the length ($L_i$) of each following segment of the said accelerating structure relates to that in the previous segment ($L_{i-1}$), as the average electron velocity in the previous segment relates to that in the following segment;

the distance $L_g$ between the gap centers of bunch resonator (2) and booster resonator (3) is selected according to velocity $v_o$ of electron stream at the input to bunch resonator (2) and microwave field wavelength λ of high-frequency power source in free space, based on the following relation:

$$\frac{L_g}{\beta_0} = \frac{4n-1}{4}\lambda,$$

where $\beta_o = v_o/c$, c is light velocity, n=1, 2, 3 . . . , and voltage $U_g$ at the gap of bunch resonator (2) is selected from relation $$\frac{U_g}{U_0} \approx \frac{7.36}{\pi(4n-1)},$$

where $U_o$ is electron source voltage, n=1, 2, 3 . . . .

10. Accelerator specified in claim 9, but distinguished by the fact that accelerating units in accelerating structure (1) providing acceleration of electrons with kinetic energy above the rest energy enables to further increase electron energy; meantime, successively arranged segments of equal lengths ($L_i$) are arranged in groups, and the length of individual segment in group and their numbers are such, that phase shift of accelerated particle with respect to accelerating field after its passage in a group of segments, doesn't exceed $10^0$.

11. Accelerator specified in claim 9, but distinguished by the fact that in the said accelerating structure (1) accelerating units (2, 3, $4_i$) are interconnected to each other by internal or side connection cells (5, $6_i$).

12. Accelerator specified in claim 9, but distinguished by the fact that it contains electrons source (10) with injection energy within the range of 10-20 keV.

13. Accelerator specified in claim 9, but distinguished by the fact that it contains electron gun (10) with thermal cathode and two or more electrodes, as a source of electrons.

14. Accelerator specified in claim 9, but distinguished by the fact that it contains magnetrons ($11_1$, . . . , $11_L$) as a source of high-frequency power ($11_1$, . . . $11_L$) the magnetrons are adopted for synchronization by electromagnetic field signal generated by accelerated bunch in accelerating structure (1) and entering to magnetrons outputs ($\mathbf{11}_1, \ldots \mathbf{11}_L$) via wave-guide duct ($\mathbf{12}_1, \ldots \mathbf{12}_L$) and decoupler ($\mathbf{16}_1, \ldots \mathbf{16}_L$), being superimposed by the signal of high-frequency field excited by magnetron ($\mathbf{11}_1, \ldots \mathbf{11}_L$) in the said structure (1), this accelerator contains:

mechanical control ($\mathbf{18}_1, \ldots, \mathbf{18}_L$) of magnetron operating frequency;

device (15) providing mechanical control of magnetron operating frequency.

15. Accelerator specified in claim 9, but distinguished by the fact that it contains externally excited klystrons ($\mathbf{11}_1, \ldots \mathbf{11}_N$), adopted for synchronization with high-frequency signal of driving generator (19), as a source of high-frequency power ($\mathbf{11}_1, \ldots \mathbf{11}_N$) further including:

power splitter (22) of the said driving generator (19);

devices ($\mathbf{21}_1, \ldots, \mathbf{21}_N$) for amplitude and phase monitoring of high-frequency signal located after the said power splitter (22), before the input of each of the said klystrons ($\mathbf{11}_1, \ldots \mathbf{11}_N$);

amplitude monitor (15) providing driving generator (19) control and devices ($\mathbf{21}_1, \ldots, \mathbf{21}_N$) for controlling of amplitude and phase of high-frequency signal at the inputs of the said klystrons.

16. Accelerator specified in claim 9, but distinguished by the fact that it contains klystrons ($\mathbf{11}_1, \ldots \mathbf{11}_M$), each of them operates in self-oscillating mode with accelerating structure (1) in a feedback circuit, as a source of high-frequency power ($\mathbf{11}_1, \ldots \mathbf{11}_M$) including:

power splitter (22) of the said receiving antenna (14);

devices ($\mathbf{21}_1, \ldots, \mathbf{21}_M$) for amplitude and phase monitoring of high-frequency signal, located after the said power splitter (22) before the input of each of the said klystrons ($\mathbf{11}_1, \ldots \mathbf{11}_M$);

amplitude monitor (15) providing driving generator (19) control and devices ($\mathbf{21}_1, \ldots, \mathbf{21}_M$) for amplitude and phase monitoring of high-frequency signal at the inputs of the said klystrons.

17. Low-energy continuous linear electron accelerators with standing wave, including:

low-energy electron source (10);

accelerating structure (1') for low-energy electrons implemented in the form of several successively arranged accelerating sections ($\mathbf{1}_1, \ldots, \mathbf{1}_j$) not connected by electromagnetic field;

several high-frequency power sources ($\mathbf{11}_1, \ldots, \mathbf{11}_j$), each of them feeding one of the sections ($\mathbf{1}_1, \ldots, \mathbf{1}_j$) of the said accelerating structure (1');

power supply (13) feeding the said electron source and poser source (10) and the said power sources ($\mathbf{11}_1, \ldots, \mathbf{11}_j$);

receiving antennas ($\mathbf{14}_1, \ldots, \mathbf{14}_j$) located each in one of accelerating units of each of the said sections ($\mathbf{1}_1, \ldots, \mathbf{1}_j$) of the structure (1') and adopted for acquisition of high-frequency signal for amplitude and phase monitoring of accelerating field;

and, in the meantime, the said accelerating sections ($\mathbf{1}_1, \ldots, \mathbf{1}_j$) of the said structure (1') include successively arranged accelerating units (2, 3, $\mathbf{4}_i$) adopted for formation of electromagnetic field under the sources of high-frequency power ($\mathbf{11}_1, \ldots \mathbf{11}_j$), where each previous accelerating unit is connected to the following accelerating unit by coupling slots (7) through connection cells ($\mathbf{5}, \mathbf{6}_i$), and in the first section ($\mathbf{1}_1$) of the said accelerating structure (1'):

first accelerating unit is implemented in the form of bunch resonator (2) adopted for direct communication with low-energy electrons source (10), second accelerating unit is implemented in the form of booster resonator (3) adopted for energy increase of incoming electrons up to the values providing their acceleration in the following part of accelerating structure, and the distance $L_g$ between the gap centers of bunch resonator (2) and booster resonator (3) is selected according to velocity $v_o$ of electron stream at the input to bunch resonator (2) and microwave field wavelength $\lambda$ of high-frequency power source in free space based on the following relation $$\frac{L_g}{\beta_0} = \frac{4n-1}{4}\lambda,$$

where $\beta_o = v_o/c$, c is light velocity, n=1, 2, 3 . . . , and voltage $U_g$ at the gap of bunch resonator (2) is selected from relation $$\frac{U_g}{U_0} \approx \frac{7.36}{\pi(4n-1)},$$

where $U_o$ is electron source voltage, n=1, 2, 3 . . . and units following after the second accelerating unit ($\mathbf{4}_i$) are adopted to increase the energy of entering electrons up to required value and, at least, for accelerating structures, to which non-relativistic electrons enter with kinetic energy less than rest energy, the lengths ($L_i$) between the centers of adjacent connection cells (5,6*i*) of accelerating unit (1), including the said accelerating unit ($\mathbf{4}_i$), are selected so that the length ($L_i$) of each following segment of the said accelerating structure relates to that in the previous segment ($L_{i-1}$), as the average electron velocity in the previous segment relates to that in the following segment.

18. Accelerator specified in claim 17, but distinguished by the fact that in the said accelerating structure (1') accelerating (2,3,$\mathbf{4}_i$) are interconnected to each other by internal or side connection cells ($\mathbf{5}, \mathbf{6}_i$).

19. Accelerator specified in claim 17, but distinguished by the fact that it contains electrons source (10) with injection energy within the range of 10-20 keV.

20. Accelerator specified in claim 17, but distinguished by the fact that it contains electron gun (10) with thermal cathode and two or more electrodes, as a source of electrons.

21. Accelerator specified in claim 17, but distinguished by the fact that it contains magnetrons ($\mathbf{11}_1, \ldots, \mathbf{11}_L$) as a source of high-frequency power of ($\mathbf{11}_1, \ldots \mathbf{11}_L$) for individual accelerating sections ($\mathbf{1}_1, \ldots \mathbf{1}_j$) the accelerator contains:

device ($\mathbf{15}_1, \ldots, \mathbf{15}_j$) providing mechanical control of magnetron operating frequency;

decoupler ($\mathbf{16}_1, \ldots, \mathbf{16}_j$) providing magnetron protection from high-frequency signal reflected from the accelerating structure;

directional coupler ($\mathbf{17}_1, \ldots, \mathbf{17}_j$) providing the acquisition of high-frequency signal for amplitude and phase control of magnetron output;

mechanical control ($\mathbf{18}_1, \ldots, \mathbf{18}_j$) of magnetron operating frequency, these magnetrons are adopted for synchronization by electromagnetic field signal generated by accelerated bunch in the said accelerating section ($\mathbf{1}_1, \ldots, \mathbf{1}_j$) via wave-guide duct ($\mathbf{12}_1, \ldots \mathbf{12}_j$) and entered to magnetrons outputs, and decoupler ($\mathbf{16}_1, \ldots \mathbf{16}_j$), this signal is being superimposed by the signal of high-frequency field excited by magnetron in the said structure ($\mathbf{1}_1, \ldots \mathbf{1}_j$).

22. Accelerator specified in claim 17, but distinguished by the fact that it uses klystrons ($\mathbf{11}_1, \ldots, \mathbf{11}_Q$) as a source of high-frequency power ($\mathbf{11}_1, \ldots \mathbf{11}_Q$) for individual accelerating sections ($\mathbf{1}_1, \ldots \mathbf{1}_Q$), these klystrons are adopted for operation under external excitation and for synchronization with general control high-frequency signal by driving generator (19) via power splitter (22), the accelerator contains the following for each of accelerating sections ($\mathbf{1}_1, \ldots \mathbf{1}_Q$):

resonance frequency controller ($\mathbf{23}_1, \ldots, \mathbf{23}_Q$) for the said sections ($\mathbf{1}_1, \ldots \mathbf{1}_Q$);

controlling devices ($\mathbf{21}_1, \ldots, \mathbf{21}_Q$) of amplitude and phase, located after the said power splitter (22) before the input of each of the said klystrons ($\mathbf{11}_1, \ldots \mathbf{11}_Q$);

controlling device ($\mathbf{15}_1, \ldots, \mathbf{15}_Q$) providing monitors ($\mathbf{23}_1, \ldots, \mathbf{23}_M$) of amplitude and phase of resonance frequency of the said accelerating sections and controlling the amplitude and phase monitor ($\mathbf{21}_1, \ldots, \mathbf{21}_Q$);

decoupler ($\mathbf{16}_1, \ldots, \mathbf{16}_Q$) providing klystron ($\mathbf{11}_1, \ldots \mathbf{11}_Q$) protection from high-frequency signal reflected from the accelerating structure;

directional coupler ($\mathbf{17}_1, \ldots \mathbf{17}_Q$) installed at klystrons ($\mathbf{11}_1, \ldots \mathbf{11}_Q$) outputs and providing the acquisition of high-frequency signal for amplitude and phase control of klystron output.

23. Accelerator specified in claim 17, but distinguished by the fact it uses klystrons ($\mathbf{11}_1, \ldots, \mathbf{11}_T$) as a source of high-frequency power ($\mathbf{11}_1, \ldots \mathbf{11}_T$) for individual accelerating sections, the accelerating sections are operated in self-oscillating mode with relevant accelerating section ($\mathbf{1}_1, \ldots \mathbf{1}_T$) in a feedback circuit and, starting from the second section ($\mathbf{1}_2$), they are adopted for synchronization with high-frequency signal of the first accelerating section ($\mathbf{1}_2$), the accelerator contains the following for each of accelerating section ($\mathbf{1}_1, \ldots \mathbf{1}_T$):

controlling devices ($\mathbf{21}_1, \ldots, \mathbf{21}_T$) of amplitude and phase monitor, located before the input of the klystron ($\mathbf{11}_1, \ldots \mathbf{11}_T$);

controlling device ($\mathbf{15}_1, \ldots, \mathbf{15}_T$) providing the amplitude and phase monitoring ($\mathbf{21}_1, \ldots, \mathbf{21}_T$) at the input of the said klystron ($\mathbf{11}_1, \ldots \mathbf{11}_T$) . . . .

and contains controlling device ($\mathbf{23}_1$) in the first section of accelerating section ($\mathbf{1}_1$), adopted for offset of some part of high-frequency signal of the said antenna ($\mathbf{14}_1$) in this section ($\mathbf{1}_1$);

as well as contains power splitter (22) adopted for splitting the power of the said offset high-frequency signal on the part or on several parts one less than number of accelerating section in accelerating structure;

and contains the following for each of accelerating section ($\mathbf{1}_2, \ldots, \mathbf{1}_T$):

phase changer ($\mathbf{25}_2, \ldots, \mathbf{25}_T$) adopted for phase control of the said part of offset signal;

controlling device ($\mathbf{24}_2, \ldots, \mathbf{24}_T$) adopted for dithering of the said part of offset signal into feedback circuit of the said klystron.

24. Accelerator specified in claim 17, but distinguished by the fact that it uses klystrons ($\mathbf{11}_1, \ldots, \mathbf{11}_H$) as a source of high-frequency power ($\mathbf{11}_1, \ldots \mathbf{11}_H$) for individual accelerating sections ($\mathbf{1}_1, \ldots, \mathbf{1}_H$), the klystrons are operated in self-oscillating mode with relevant accelerating section in a feedback circuit and are adopted for synchronization with high-frequency signal generated by accelerating bunch in the said accelerating section and entering to the outputs of klystrons ($\mathbf{11}_1, \ldots, \mathbf{11}_H$) from said antenna ($\mathbf{14}_1, \ldots, \mathbf{14}_H$), this signal is superimposed by high-frequency signal excited by klystrons in the said accelerating section ($\mathbf{1}_1, \ldots, \mathbf{1}_H$), accelerator contains the following for each of accelerating sections ($\mathbf{1}_1, \ldots \mathbf{1}_H$):

controlling devices ($\mathbf{21}_1, \ldots, \mathbf{21}_H$) of amplitude and phase monitor, located before the input of the klystron ($\mathbf{11}_1, \ldots \mathbf{11}_H$);

controlling device ($\mathbf{15}_1, \ldots, \mathbf{15}_H$) providing controlling the amplitude and phase monitor ($\mathbf{21}_1, \ldots, \mathbf{21}_H$) at the input of the said klystron.

* * * * *